US007114930B2

(12) United States Patent
Ogasawara et al.

(10) Patent No.: US 7,114,930 B2
(45) Date of Patent: Oct. 3, 2006

(54) COMPRESSOR

(75) Inventors: Hirotsugu Ogasawara, Ota (JP); Takahiro Nishikawa, Ota (JP); Akihiro Suda, Gunma-ken (JP); Masayuki Hara, Gunma-ken (JP); Makoto Oonuki, Utsunomiya (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 11/028,334

(22) Filed: Jan. 4, 2005

(65) Prior Publication Data

US 2005/0152792 A1 Jul. 14, 2005

(30) Foreign Application Priority Data

Jan. 8, 2004 (JP) ..... 2004-003142

(51) Int. Cl.
*F04C 2/344* (2006.01)

(52) U.S. Cl. ..... 418/151; 418/232

(58) Field of Classification Search ..... 418/151, 418/219, 229, 230, 231, 232
See application file for complete search history.

(56) References Cited

U.S. PATENT DOCUMENTS 3,942,920 A * 3/1976 Sakamaki ..... 418/230
4,437,823 A 3/1984 Tigane ..... 418/219
5,597,293 A * 1/1997 Bushnell et al. ..... 418/151
2003/0235510 A1 12/2003 Kim et al. ..... 418/219

FOREIGN PATENT DOCUMENTS

| | | |
|---|---|---|
| DE | 34 04 158 | 8/1985 |
| JP | 50-125307 | 10/1975 |
| JP | 54108914 A * | 8/1979 |
| JP | 58-195091 | 11/1983 |
| JP | 5-99172 | 4/1993 |
| JP | 2003-532008 | 10/2003 |

OTHER PUBLICATIONS

European Search Report dated Jun. 2, 2005.

* cited by examiner

*Primary Examiner*—Michael Koczo, Jr.
(74) *Attorney, Agent, or Firm*—Armstrong, Kratz, Quintos, Hanson & Brooks, LLP

(57) ABSTRACT

There is provided an efficient compressor which is simple in structure and small in torque fluctuation. The compressor comprises a compression element which comprises a cylinder having a compression space formed therein, a suction port and a discharge port which communicate with the compression space in the cylinder, a compression member which comprises continuous thick and thin parts, one surface of which inclines, which is arranged in the cylinder to rotate, and which compresses fluids sucked through the suction port and discharges the compressed fluids through the discharge port, and a vane which is arranged between the suction port and the discharge port to abut on one surface of the compression member, and which partitions the compression space of the cylinder into a low pressure chamber and a high pressure chamber.

12 Claims, 21 Drawing Sheets

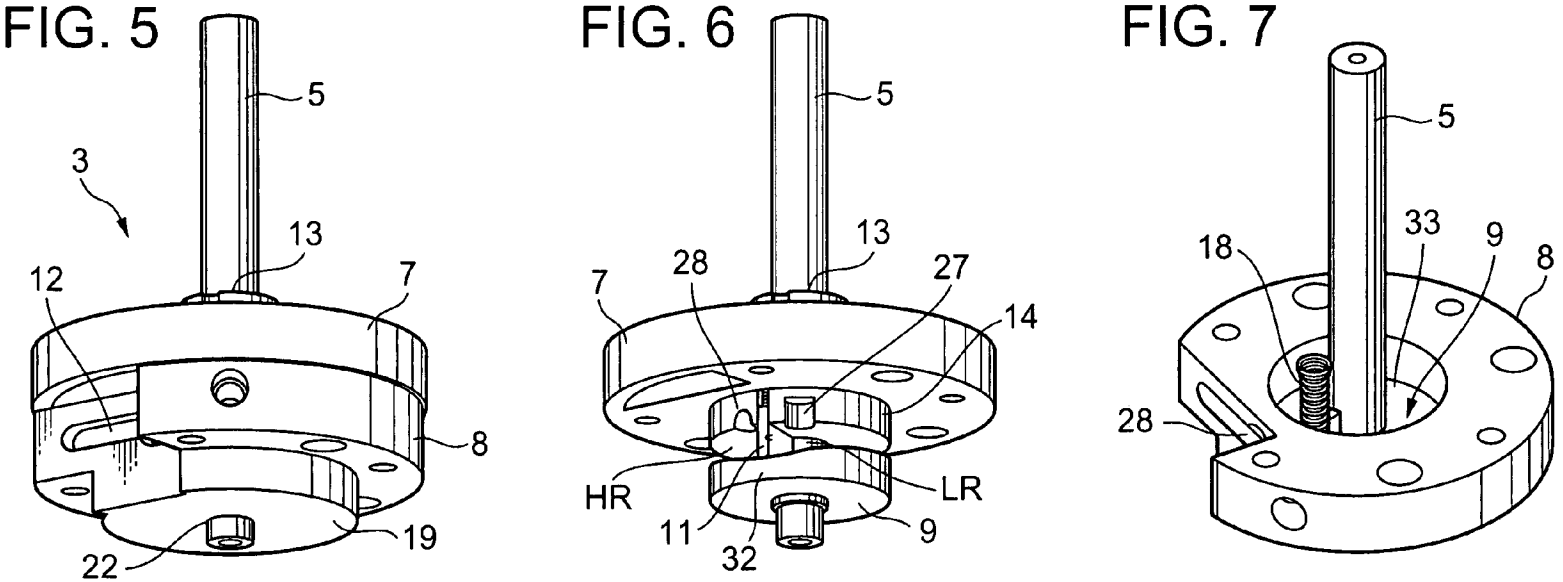
FIG. 5
FIG. 6
FIG. 7
5
13
3
12
7
8
19
22
14
27
28
LR
HR
11
32
9
33
18
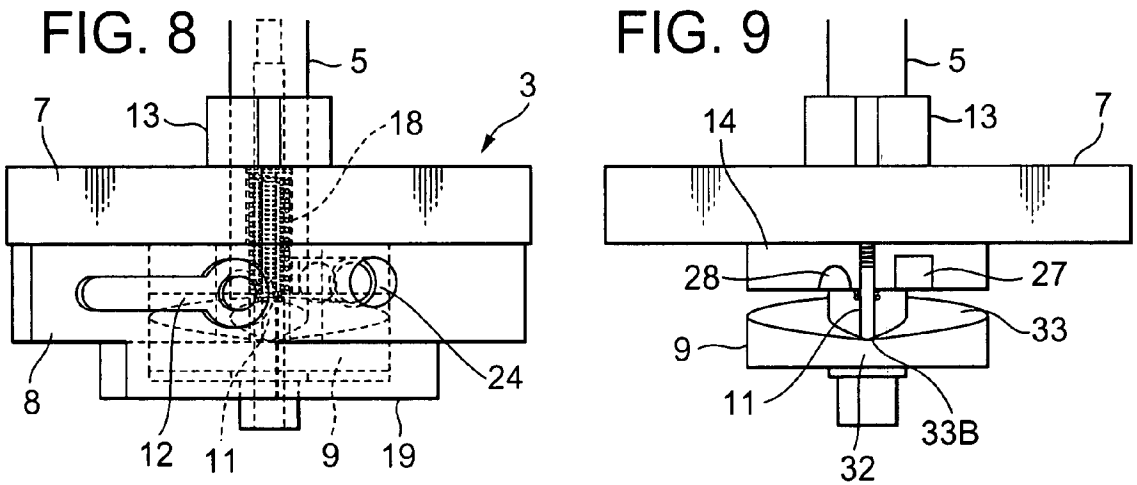
FIG. 8
FIG. 9
5
13
7
8
3
18
24
19
9
11
12
14
28
27
33
33B
32

5
13
7
8
19
22
12
3
14
27
9
LR
39
32
38
11
28
HR
33
18
24
33B

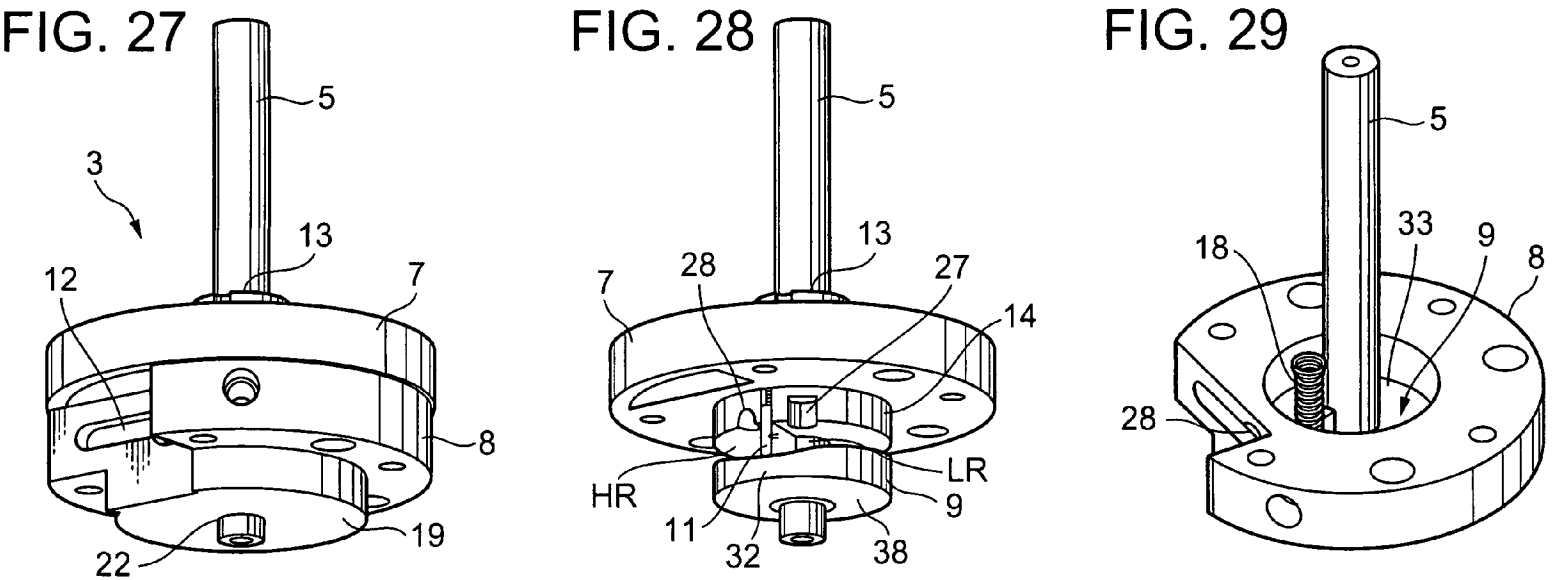
FIG. 27
FIG. 28
FIG. 29
5
13
7
8
19
22
3
12
14
27
28
LR
HR
9
38
32
11
33
18
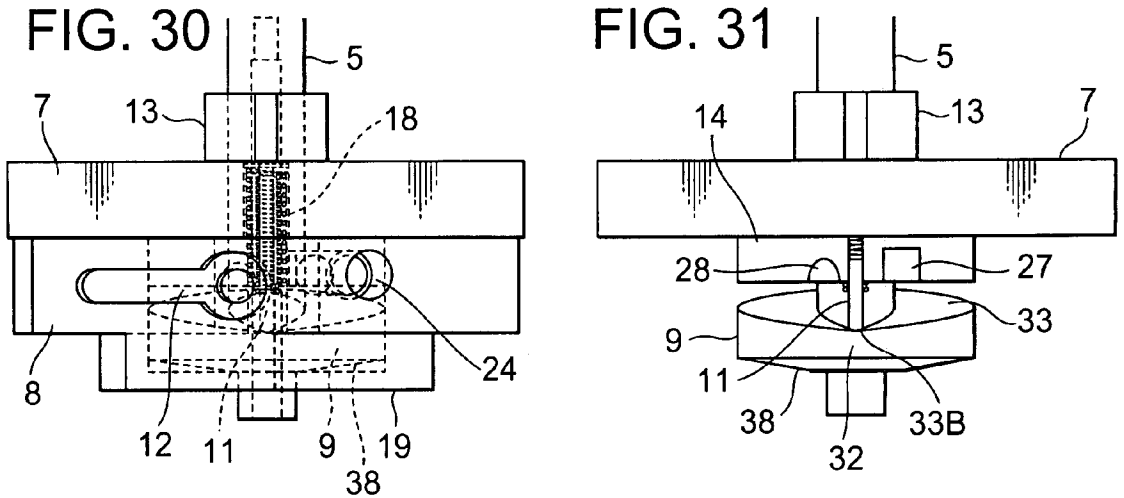
FIG. 30
FIG. 31
5
13
7
8
18
24
19
38
9
11
12
27
33
33B
32
14
28

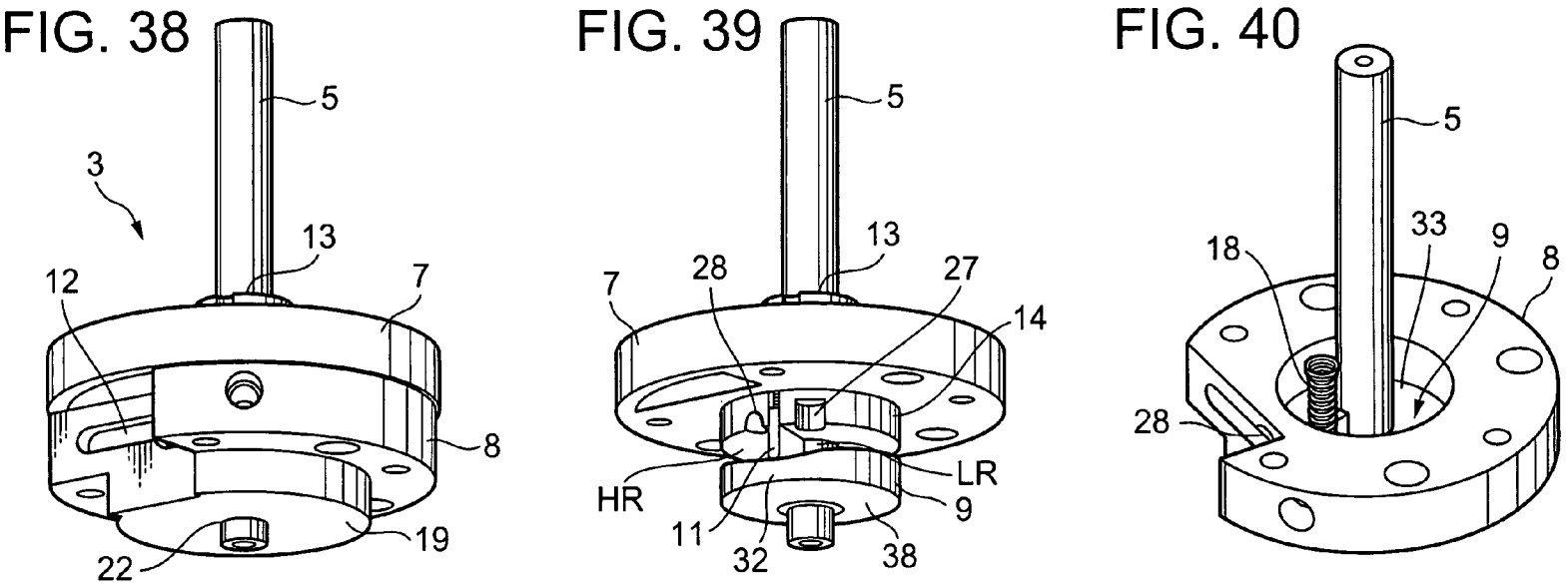
FIG. 38
FIG. 39
FIG. 40
5
13
7
8
19
22
12
3
14
27
LR
9
38
32
11
28
HR
33
18
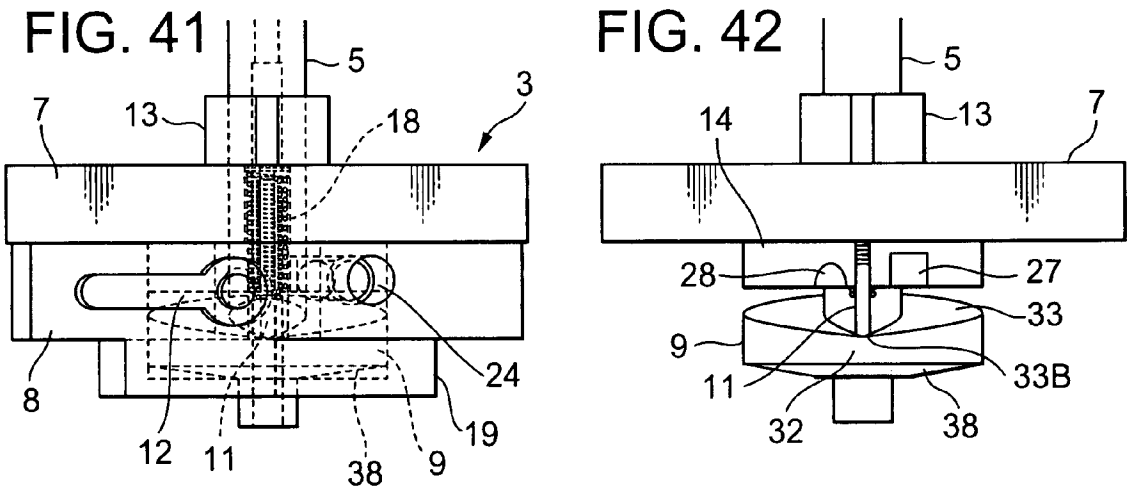
FIG. 41
FIG. 42
5
13
7
8
3
18
24
19
9
38
11
12
14
28
27
33
33B
32

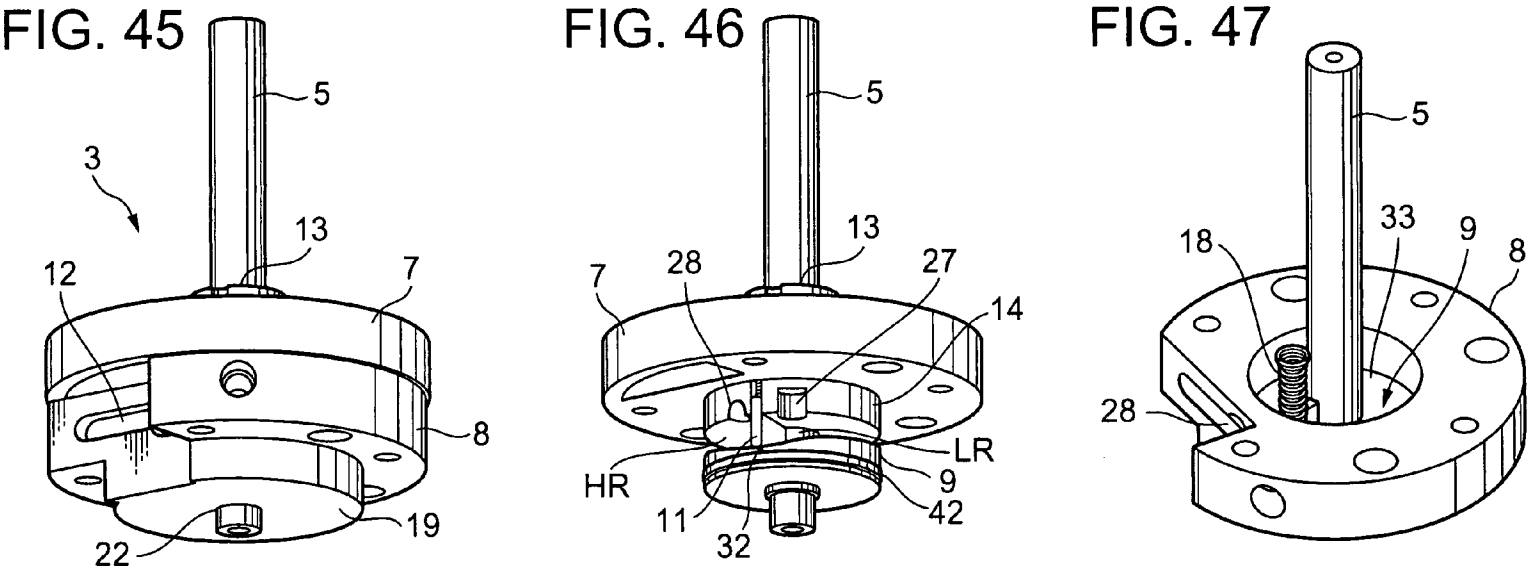
FIG. 45
FIG. 46
FIG. 47
5
13
3
12
7
8
19
22
14
27
28
LR
9
42
32
11
HR
33
18
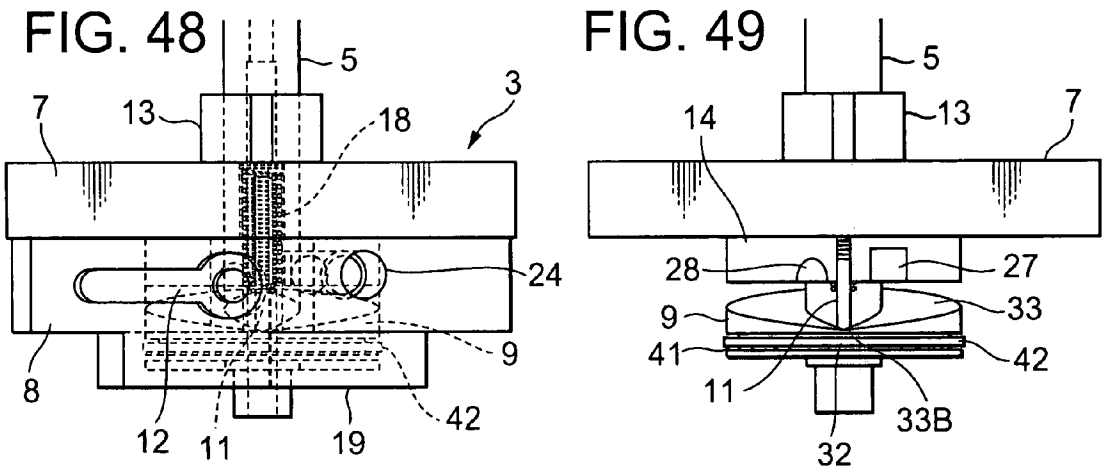
FIG. 48
FIG. 49
5
13
3
24
9
42
18
19
11
12
7
8
27
33
33B
32
14
28
41

COMPRESSOR

BACKGROUND OF THE INVENTION

1. Field of the Invention

The present invention relates to a compressor which compresses fluids such as refrigerants or air and discharges the compressed fluids.

2. Description of the Related Art

Conventionally, for example, a refrigerator has employed a system of compressing a refrigerant by using a compressor and circulating the compressed refrigerant in a circuit. As such compressor systems in this case, there are available a rotary compressor called a rotary type compressor (e.g., see Japanese Patent Application Laid-Open No. 5-99172), a scroll compressor and a screw compressor.

The rotary compressor has advantages in that a structure is relatively simple and production costs are low, but there is a problem of increases in vibration and torque fluctuation. In the case of the scroll compressor and the screw compressor, there is a problem of high costs caused by bad workability while torque fluctuation is small.

Thus, there has been developed a system which disposes a rotary swash plate in a cylinder and partitions compression spaces constituted below and above the swash plate by a vane to compress fluids (e.g., PCT No. 2003-532008). According to the compressor of this system, there is an advantage of constituting a compressor which is relatively simple in structure and small in vibration.

However, in the case of the structure of the Patent Document 2, because a high pressure chamber and a low pressure chamber are adjacent to each other below and above the swash plate in the entire region of the cylinder, a difference between high and low pressures is enlarged, and refrigerant leakage causes a problem of efficiency deterioration

SUMMARY OF THE INVENTION

The present invention has been made to solve the aforementioned conventional technical problems, and it is an object of the invention to provide an efficient compressor which is simple in structure and small in torque fluctuation.

A first aspect of the present invention is directed to a compressor comprising a compression element constituted of a cylinder having a compression space formed therein; a suction port and a discharge port which communicate with the compression space in the cylinder; a compression member having continuous thick and thin parts, one surface of the compression member being inclined, the compression member being arranged in the cylinder to rotate, the compression member compressing fluids sucked through the suction port and discharging the compressed fluids through the discharge port; and a vane which is arranged between the suction port and the discharge port to abut on one surface of the compression member and which partitions the compression space of the cylinder into a low pressure chamber and a high pressure chamber.

According to the compressor of the invention, a sufficient compression function can be exhibited while it is compact and a structure is simple. Especially, because the conventional adjacent arrangement of high and low pressures in the entire region of the cylinder is eliminated, and the compression member has continuous thick and thin parts and exhibits a shape in which one surface is inclined, a sufficient sealing size can be secured between the thick part which corresponds to a high pressure chamber and the cylinder.

Thus, the occurrence of leakage can be effectively prevented to enable efficient running. Furthermore, because the thick part of the compression member plays a role of a flywheel, torque fluctuation is reduced.

A second aspect of the present invention is directed to the above compressor, further comprising a driving element and a rotary shaft which transmits a rotational force of the driving element to the compression member, wherein the compression element and the driving element are arranged in the sealed container, the suction port is connected to a suction pipe mounted to the sealed container, the discharge port communicates with the inside of the sealed container, and a discharge pipe is connected to the sealed container.

According to the compressor of the invention, in addition to the above, a so-called internal high-pressure type compressor is realized, and the structure can be simplified more. Moreover, because a pressure difference between the high pressure chamber of the cylinder and the sealed container is reduced, leakage can be suppressed more.

A third aspect of the present invention is directed to the above compressor, wherein the compression element comprises a support member which has a main bearing of the rotary shaft to close an opening of the cylinder, and the cylinder comprises a sub-bearing of the rotary shaft positioned on a side opposite to the support member.

According to the compressor of the invention, in addition to the above, it is not necessary to separately dispose a sub-bearing support member of a rotary shaft, and thus the number of components can be reduced and more miniaturization is possible.

A fourth aspect of the present invention is directed to the above compressor, wherein the vane is arranged in a slot formed in the support member to reciprocate, and urging means is disposed in the support member to always urge the vane to one surface side of the compression member.

According to the compressor of the invention, in addition to the above, it is not necessary to form a vane mounting structure in the cylinder which necessitates accuracy. Thus, workability can be improved.

A fifth aspect of the present invention is directed to the above compressor, wherein the compression member is formed integrally with the rotary shaft.

According to the compressor of the invention, the number of components can be reduced more.

A sixth aspect of the present invention is directed to the above compressor, wherein a recess is formed on the other surface of the compression member to be positioned in the thick part.

According to the compressor of the invention, in addition to each of the above inventions, the weight of the compression member is made uniform, and the occurrence of vibration by eccentricity can be suppressed without using any balance weights.

A seventh aspect of the present invention is directed to the above compressor, wherein the other surface of the compression member is inclined to approach a peripheral part thereof to one surface side.

According to the compressor of the invention, in addition to each of the above inventions, air resistance during the rotation of the compression member is reduced, and efficiency can be improved more.

An eighth aspect of the present invention is directed to the above compressor, wherein the inclination of the other surface of the compression member is steep in the thick part.

According to the compressor of the invention, in addition to the above, the weight of the compression member is made uniform, and the occurrence of vibration by eccentricity can be suppressed without using any balance weights.

A ninth aspect of the present invention is directed to the above compressor, wherein a piston ring is disposed in the compression member to seal a clearance between a side face periphery of the compression member and the cylinder.

According to the compressor of the invention, in addition to each of the above inventions, sealing is surely carried out between the compression member and the cylinder to enable prevention of efficiency deterioration caused by leakage.

BRIEF DESCRIPTION OF THE DRAWINGS

FIG. 5 is a perspective view showing a compression element of the compressor of FIG. 1;

FIG. 6 is another perspective view of the compression element of the compressor of FIG. 1;

FIG. 7 is yet another perspective view of the compression element of the compressor of FIG. 1;

FIG. 8 is a side view of the compression element of the compressor of FIG. 1;

FIG. 9 is another side view of the compression element of the compressor of FIG. 1;

FIG. 27 is a perspective view showing a compression element of the compressor of FIG. 25;

FIG. 28 is another perspective view of the compression element of the compressor of FIG. 25;

FIG. 29 is yet another perspective view of the compression element of the compressor of FIG. 25;

FIG. 30 is a side view of the compression element of the compressor of FIG. 25;

FIG. 31 is another side view of the compression element of the compressor of FIG. 25;

FIG. 38 is a perspective view showing a compression element of the compressor of FIG. 36;

FIG. 39 is another perspective view of the compression element of the compressor of FIG. 36;

FIG. 40 is yet another perspective view of the compression element of the compressor of FIG. 36;

FIG. 41 is a side view of the compression element of the compressor of FIG. 36;

FIG. 42 is another side view of the compression element of the compressor of FIG. 36;

FIG. 45 is a perspective view showing a compression element of the compressor of FIG. 43;

FIG. 46 is another perspective view of the compression element of the compressor of FIG. 43;

FIG. 47 is yet another perspective view of the compression element of the compressor of FIG. 43;

FIG. 48 is a side view of the compression element of the compressor of FIG. 43;

FIG. 49 is another side view of the compression element of the compressor of FIG. 43;

DETAILED DESCRIPTION OF THE PREFERRED EMBODIMENTS

Next, the preferred embodiments of the present invention will be described in detail with reference to the accompanying drawings. A compressor C of each embodiment described below constitutes, e.g., a refrigerant circuit of a refrigerator, and plays a role of sucking, compressing and discharging a refrigerant into the circuit.

First Embodiment

Figure 1:
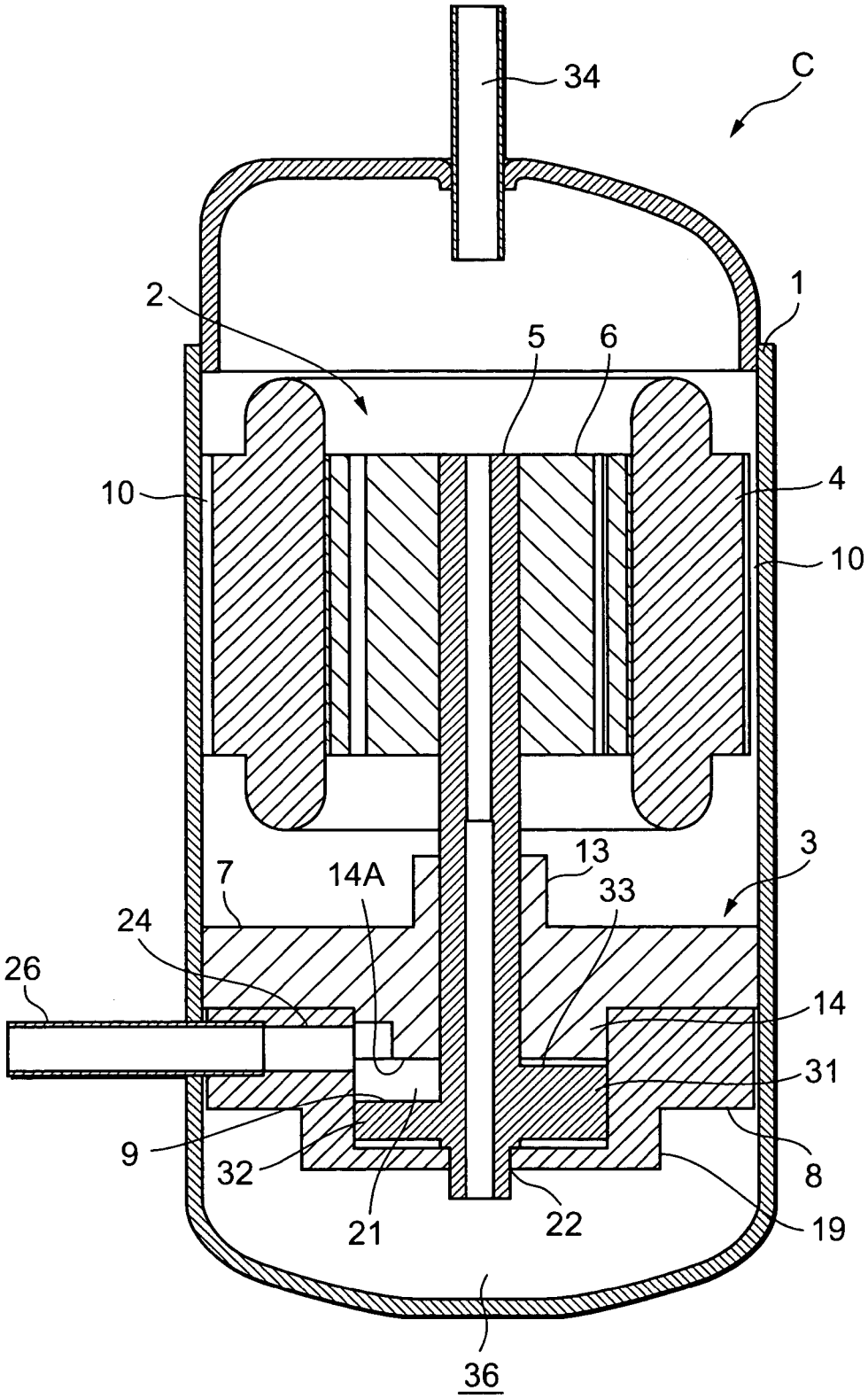
FIG. 1 is a vertical sectional side view showing a compressor according to a first embodiment of the present invention.
Figure 2:
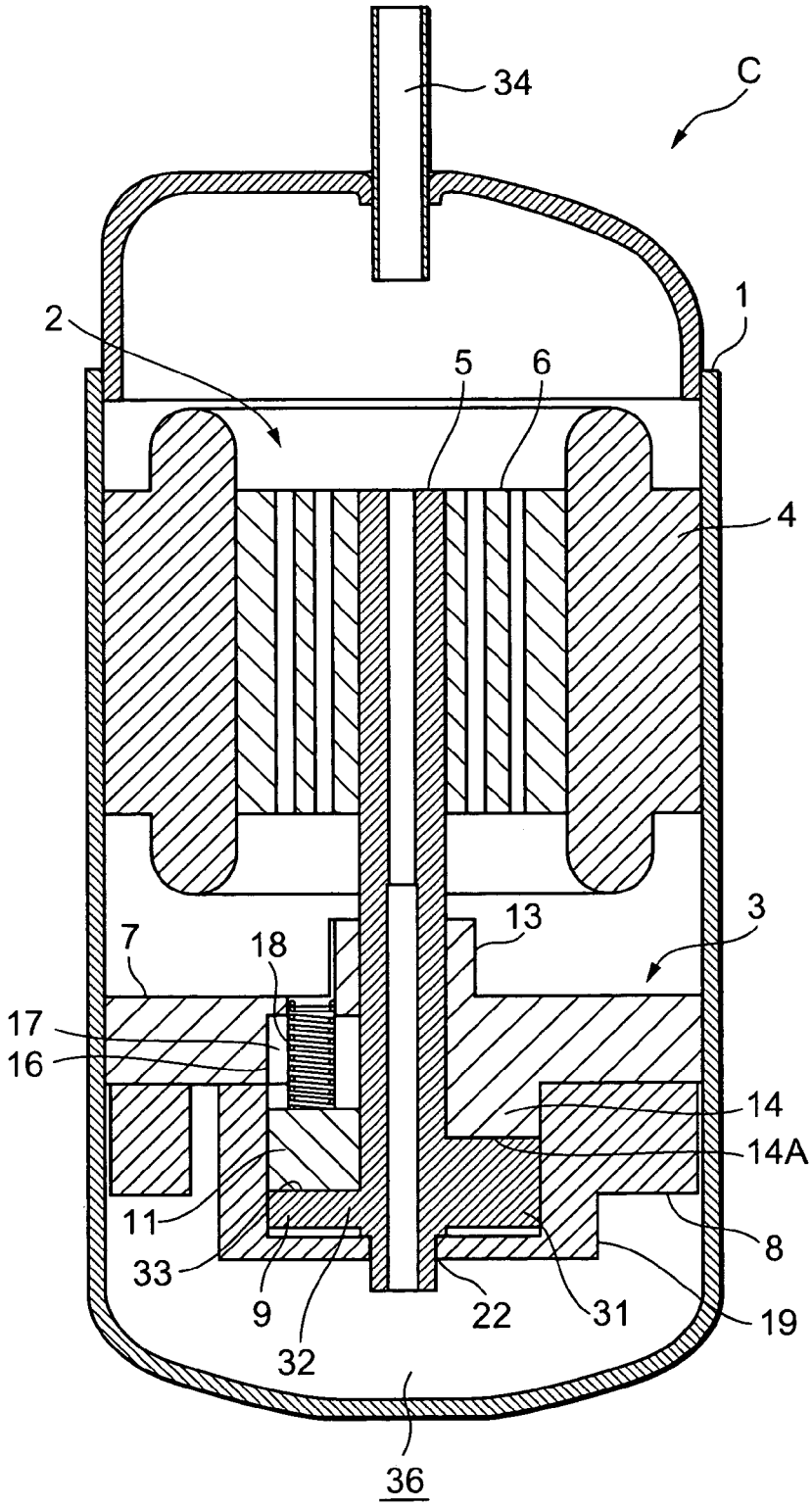
FIG. 2 is another vertical sectional side view of the compressor of FIG. 1.
Figure 3:
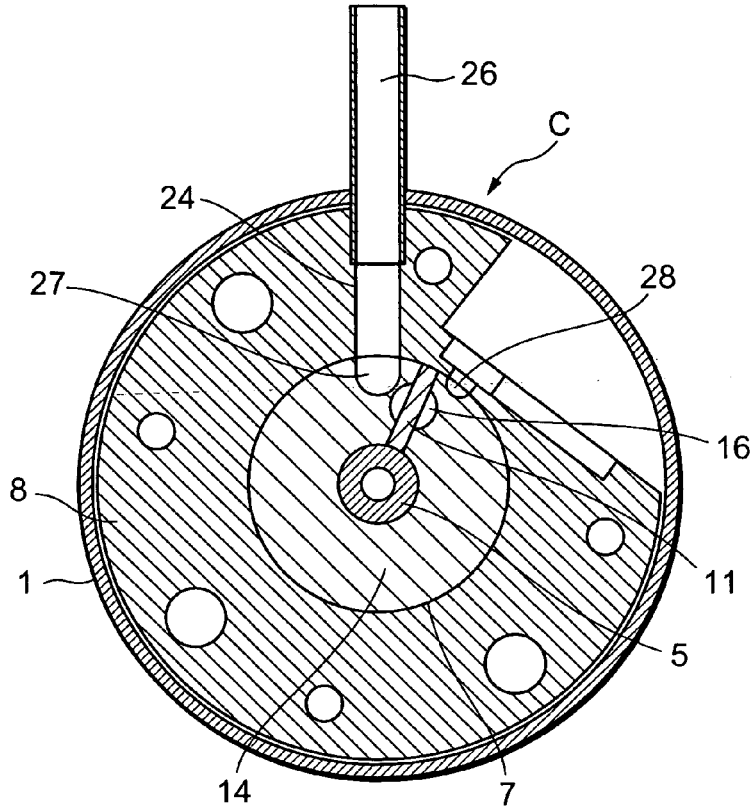
FIG. 3 is a plan sectional view of the compressor of FIG. 1.
Figure 4:
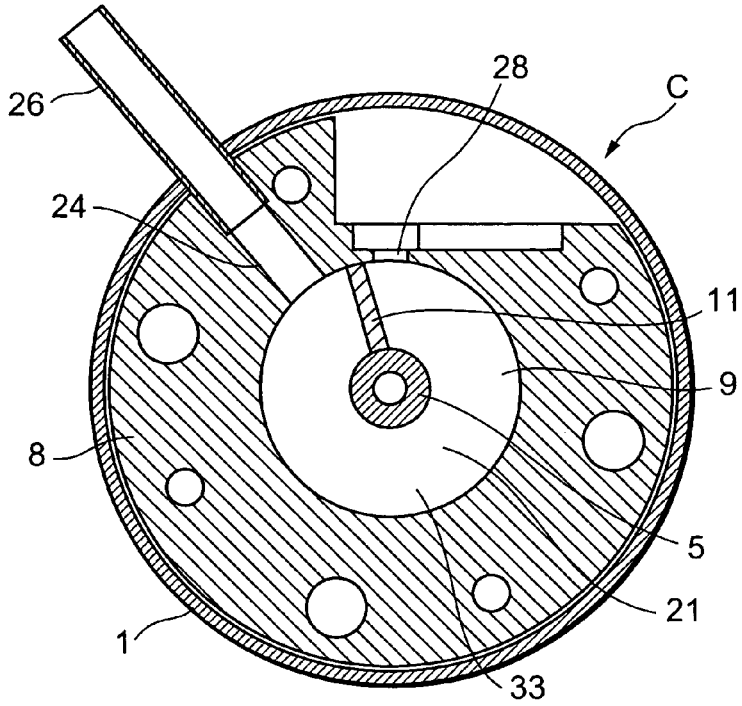
FIG. 4 is another plan sectional view of the compressor of FIG. 1.

FIG. 1 is a vertical sectional side view showing the compressor C according to a first embodiment of the present invention, FIG. 2 is another vertical sectional side view, FIG. 3 is a plan sectional view of the compressor C, FIG. 4 is another plan sectional view, FIGS. 5 to 7 are perspective views of a compression element 3 of the compressor C, and FIGS. 8, 9 are side views thereof. Throughout the drawings, a reference numeral 1 denotes a sealed container which receives a driving element 2 in its upper side and a compression element 3 driven by the driving element 2 in its lower side.

The driving element 2 is an electric motor which is fixed to an inner wall of the sealed container 1 and which comprises a stator 4 having a stator coil wound thereon and a rotor 6 having a rotary shaft 5 in a center inside the stator 4. Incidentally, a clearance 10 is formed between an outer peripheral part of the stator 4 of the driving element 2 and the sealed container 1 to communicate upper and lower sides with each other.

The compression element 3 comprises a support member 7 fixed to the inner wall of the sealed container 1, a cylinder 8 mounted to a bottom surface of the support member 7 by bolts, and a compression member 9, a vane 11, a discharge valve 12 and the like arranged in the cylinder 8. An upper surface center of the support member 7 concentrically projects upward, and a main bearing 13 of a rotary shaft 6 is formed therein. A bottom surface center concentrically and cylindrically projects downward, and a bottom surface 14A of the projected part 14 is a smooth surface.

A slot 16 is formed in the projected part 14 of the support member 7, and the vane 11 is inserted into this slot 16 to reciprocate up and down. A back pressure chamber 17 is formed in an upper part of the slot 16 to apply a high pressure of the sealed container 1 as a back pressure to the vane 11. A coil spring 18 is arranged as urging means in the slot 16 to urge an upper surface of the vane 11 downward.

A center of the cylinder 8 is recessed downward, and a compression space 21 is formed in the recess 19. A sub-bearing 22 is bored in a bottom surface center of the recess 19 of the cylinder 8. A suction passage 24 is formed in the cylinder 8, and a suction pipe 26 is mounted to the sealed container 1 to be connected to the suction passage 24. A suction port 27 and a discharge port 28 are formed in the cylinder 8 to communicate with the compression space 21. The suction passage 24 communicates with the suction port 27, and the discharge port 28 communicates with the inside of the sealed container 1 on a side face of the cylinder 8. Additionally, the vane 11 is positioned between the suction port 27 and the discharge port 28.

The rotary shaft 5 is inserted into the centers of the support member 7 and the cylinder 8, its center of an up-and-down direction is supported by a main bearing 13 to rotate, and its lower end is supported by the sub-bearing 22 to rotate. The compression member 9 is integrally formed in a lower part of the rotary shaft 5, and arranged in the recess 19 of the cylinder 8.

Figure 10:
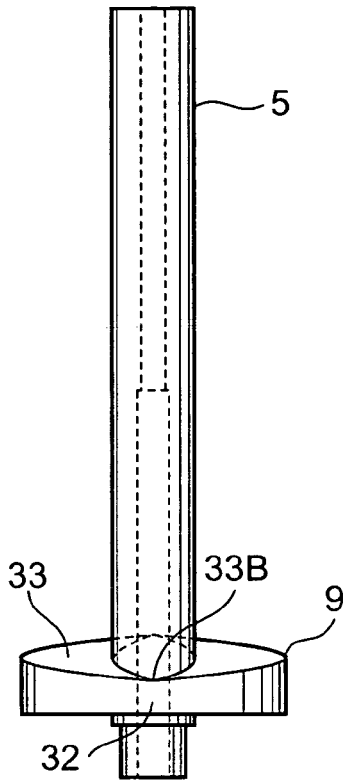
FIG. 10 is a side view of a rotary shaft which includes a compression member of the compressor of FIG. 1.
Figure 11:
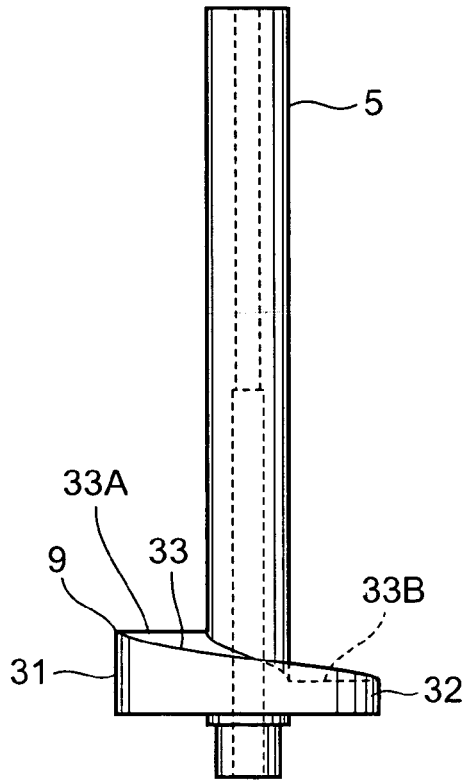
FIG. 11 is another side view of the rotary shaft which includes the compression member of the compressor of FIG. 1.
Figure 12:
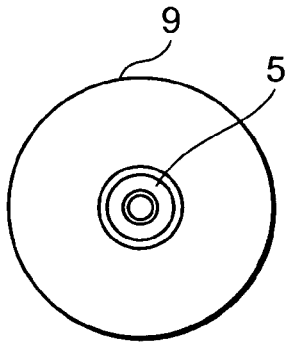
FIG. 12 is a bottom view of the rotary shaft which includes the compression member of the compressor of FIG. 1.
Figure 13:
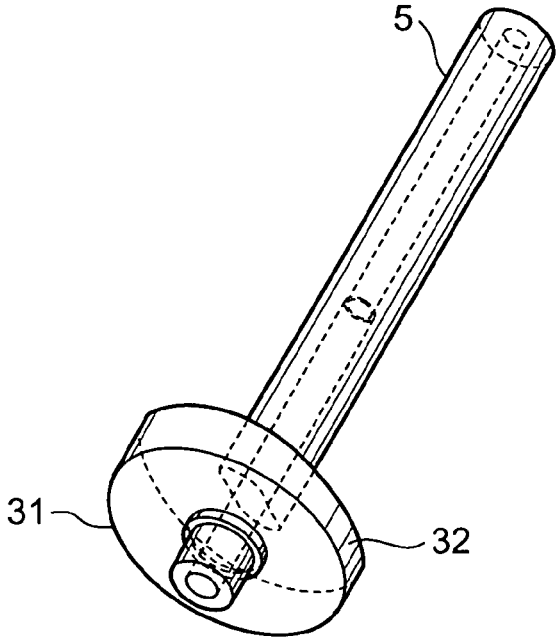
FIG. 13 is a perspective view of the rotary shaft which includes the compression member of the compressor of FIG. 1.

The compression member 9 exhibits a roughly cylindrical shape concentric to the rotary shaft 5 as a whole. FIGS. 10 and 11 are side views of the rotary shaft 5 which includes the compression member 9, FIG. 12 is a bottom view, and FIG. 13 is a perspective view. As shown in FIGS. 10 to 13, the compression member 9 exhibits a shape in which a thick part 31 of one side and a thin part 32 of the other side are continuous, and an upper surface 33 (one surface) thereof is a slope in which the thick part 31 is high and the thin part 32 is low. That is, the upper surface 33 exhibits a roughly sine wave shape in which a round around the rotary shaft 5 passes from a highest top dead center 33A to a lowest bottom dead center 33B and returns to the top dead center 33A. A sectional shape of the upper surface 33 passing through the rotary shaft 5 is parallel to a bottom surface 14A of the projected part 14 whichever is cut, and a clearance between the upper surface 33 and the bottom surface 14A becomes the compression space 21.

The top dead center 33A of the compression member 9 faces the bottom surface 14A of the projected part 14 of the support member 7 through a very small clearance to move. Incidentally, this clearance is sealed by oil sealed into the sealed container 1. The vane 11 abuts on the upper surface 33 of the compression member 9 to partition the compression space 21 of the cylinder 8 into a low pressure chamber LR and a high presser chamber HR. The coil spring 18 always urges the vane 11 to the upper surface 33 side.

A very small clearance is formed between a peripheral side face of the compression member 9 and an inner wall of the recess 19 of the cylinder 8, whereby the compression member 9 freely rotates. The clearance between the peripheral side face of the compression member 9 and the inner wall of the recess 19 of the cylinder 8 is also sealed with oil.

The discharge valve 12 is mounted to an outer side of the discharge port 28 to be positioned in a side face of the recess 19 of the cylinder 8 (not shown in FIGS. 3, 4), and a discharge pipe 34 is mounted to an upper end of the sealed container 1. An oil reservoir 36 is formed in a bottom part in the sealed container 1, and oil is supplied from this oil reservoir 36 to the compression element 3 or the like. In the sealed container 1, a predetermined amount of a carbon dioxide ($CO_2$), R-134*a*, or HC refrigerant is sealed in.

With the aforementioned construction, when power is supplied to the stator coil of the stator 4 of the driving element 2, the rotor 6 is rotated clockwise (seen from the bottom). The rotation of the rotor 6 is transmitted through the rotary shaft 5 to the compression member 9, whereby the compression member 9 is rotated clockwise in the cylinder 8 (seen from the bottom). Now, it is assumed that the top dead center 33A of the upper surface 33 of the compression member 9 is in the vane 11 side of the discharge port 28, and a refrigerant has been sucked from the refrigerant circuit through the suction pipe 26, the suction passage 24 and the suction port 27 into a space (low pressure chamber LR) surrounded with the cylinder 8, the support member 7, the compression member 9 and the vane 11 in the suction port 27 side of the vane 11.

When the compression member 9 is rotated in this state, a volume of the space is narrowed due to inclination of the upper surface from a stage at which the top dead center 33A passes through the vane 11 and the suction port 27, and the refrigerant in a space (high pressure chamber HR) is compressed. Then, the refrigerant compressed until the top dead center 33A passes through the discharge port 28 is continuously discharged from the discharge port 28. On the other hand, after the passage of the top dead center 33A through the suction port 27, the volume of the space (low pressure chamber LR) surrounded with the cylinder 8, the support member 7, the compression member 9 and the vane 11 in the suction port 27 side of the vane 11 is expanded. Accordingly, the refrigerant is sucked from the refrigerant circuit through the suction pipe 26, the suction passage 24 and the suction port 27 into the compression space 21.

The refrigerant is discharged from the discharge port 28 through the discharge valve 12 into the sealed container 1. Then, the high-pressure refrigerant discharged into the sealed container 1 passes through an air gap between the stator 4 and the rotor 6 of the driving element 2, separated from the oil in the upper part (above driving element 2) in the sealed container 1, and discharged through the discharge pipe 34 into the refrigerant circuit. On the other hand, the separated oil flows down through the clearance 10 formed between the sealed container 1 and the stator 4 to return into the oil reservoir 36.

With such a construction, though it is compact and simple in structure, the compressor C can exhibit a sufficient compression function. Especially, because the bottom surface side of the compression member 9 is at a high pressure in the sealed container 1, the conventional adjacent arrangement of high and low pressures in the entire region of the cylinder is eliminated, and the compression member has the continuous thick and thin parts 31 and 32 and exhibits a shape in which one surface is inclined, a sufficient sealing size can be secured between the thick part 31 which corresponds to the high pressure chamber HR and the inner wall of the recess 19 of the cylinder 8.

Thus, the occurrence of refrigerant leakage between the compression member 9 and the cylinder 8 can be effectively prevented to enable efficient running. Furthermore, because the thick part 31 of the compression member 9 plays a role of a flywheel, torque fluctuation is reduced. Because the compressor C is a so-called internal high-pressure type compressor, the structure can be simplified more.

According to the embodiment, because the cylinder 8 comprises the sub-bearing 22 of the rotary shaft 5 positioned in the side opposite to the support member 7, it is not necessary to separately dispose a sub-bearing support member for the rotary shaft 5. Thus, the number of components can be reduced and more miniaturization is possible. Moreover, because the slot 16 of the vane 11 is formed in the support member 7 and the coil spring 18 is disposed in the support member 7, it is not necessary to form a vane mounting structure in the cylinder 8 which necessitates accuracy, and thus workability can be improved. Furthermore, by forming the compression member 9 integrally with the rotary shaft 5 as in the case of the embodiment, the number of components can be reduced more.

Second Embodiment

Figure 14:
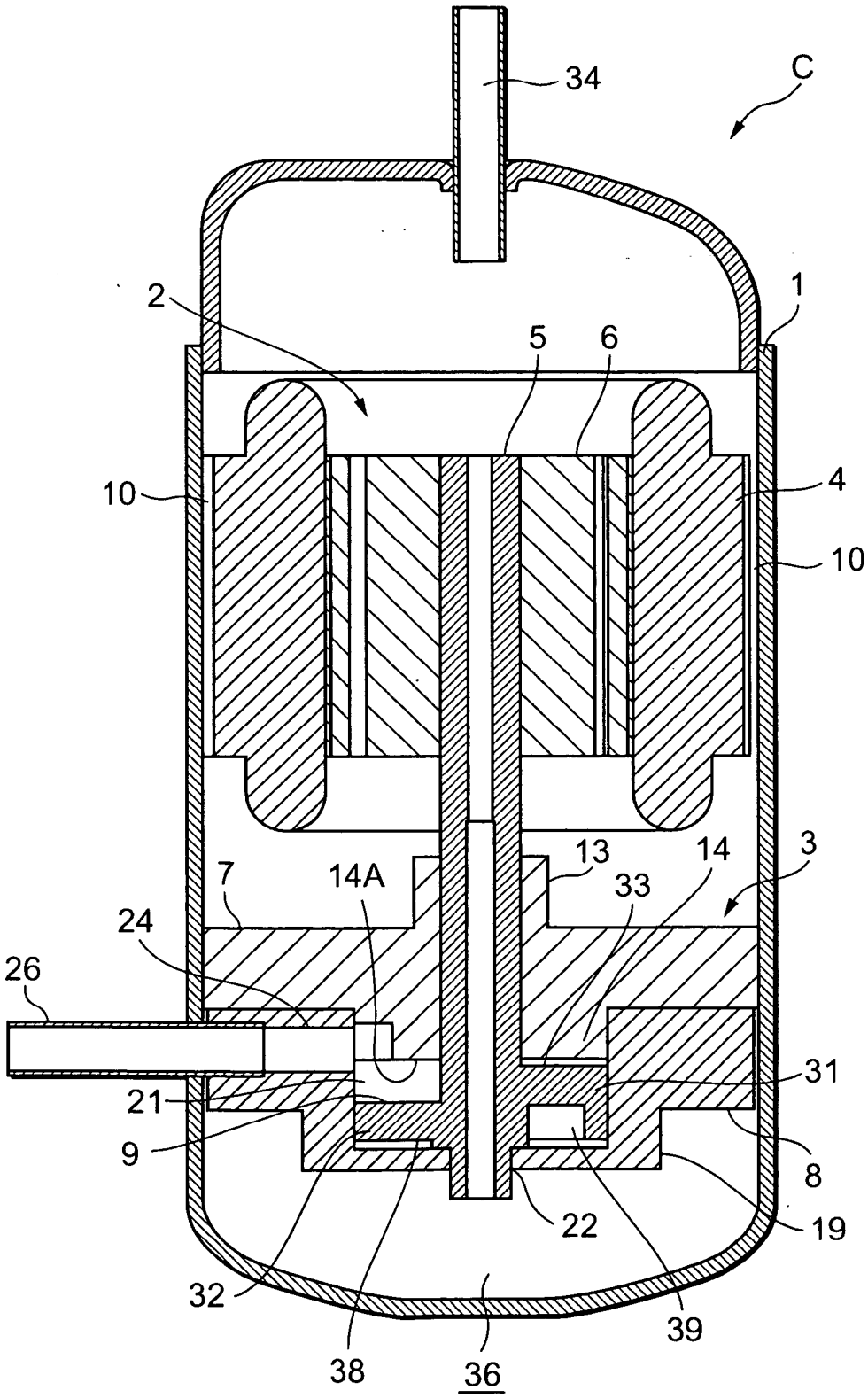
FIG. 14 is a vertical sectional side view showing a compressor according to a second embodiment of the present invention.
Figure 15:
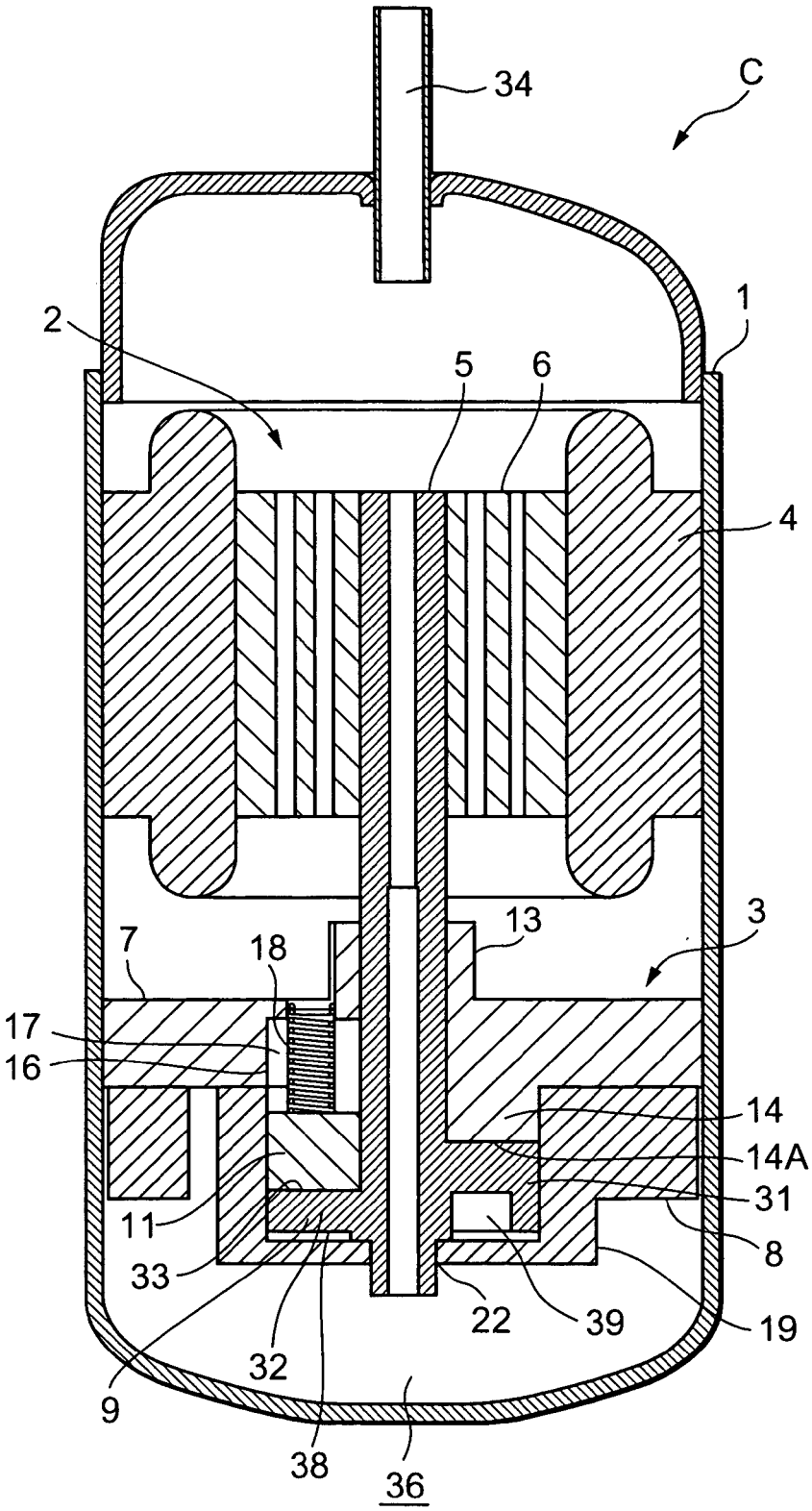
FIG. 15 is another vertical sectional side view of the compressor of FIG. 14.
Figures 16, 17, 18, 19, 20:
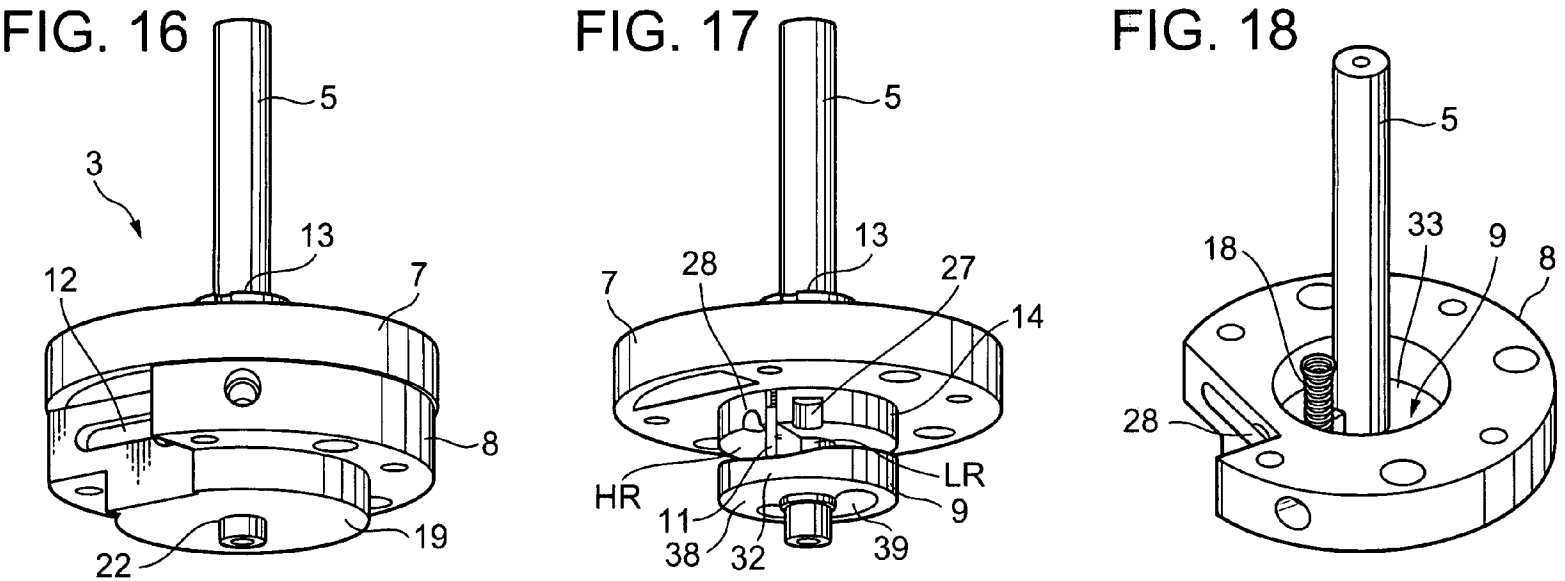
FIG. 16 is a perspective view showing a compression element of the compressor of FIG. 14.
FIG. 17 is another perspective view of the compression element of the compressor of FIG. 14.
FIG. 18 is yet another perspective view of the compression element of the compressor of FIG. 14.
FIG. 19 is a side view of the compression element of the compressor of FIG. 14.
FIG. 20 is another side view of the compression element of the compressor of FIG. 14.
Figure 21:
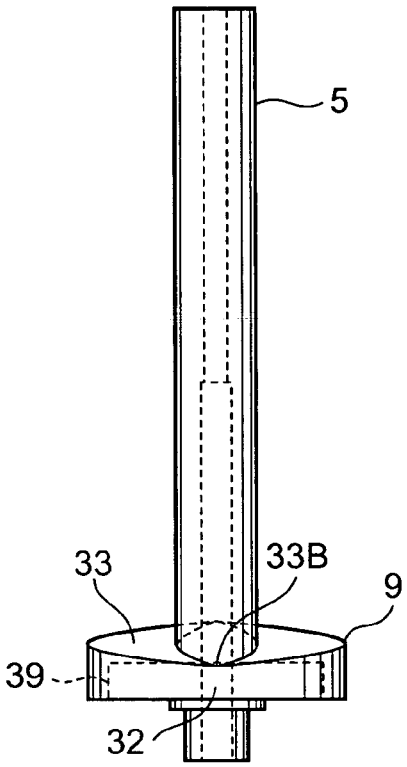
FIG. 21 is a side view of a rotary shaft which includes a compression member of the compressor of FIG. 14.
Figure 22:
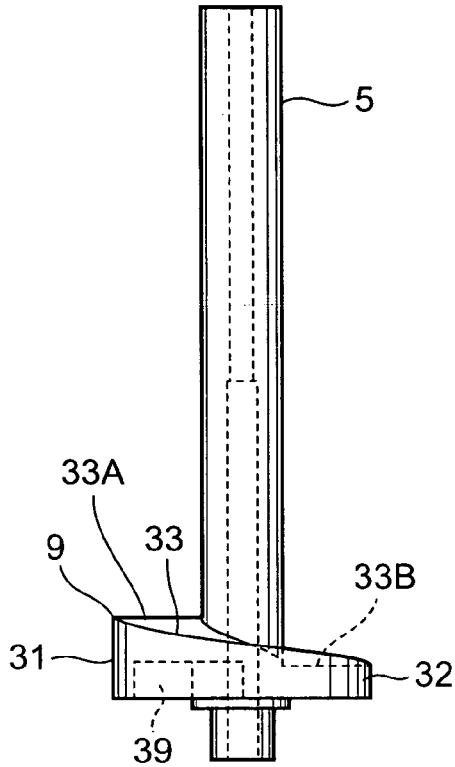
FIG. 22 is another side view of the rotary shaft which includes the compression member of the compressor of FIG. 14.
Figure 23:
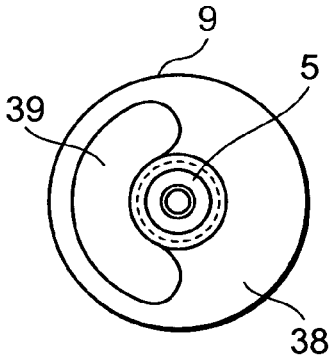
FIG. 23 is a bottom view of the rotary shaft which includes the compression member of the compressor of FIG. 14.
Figure 24:
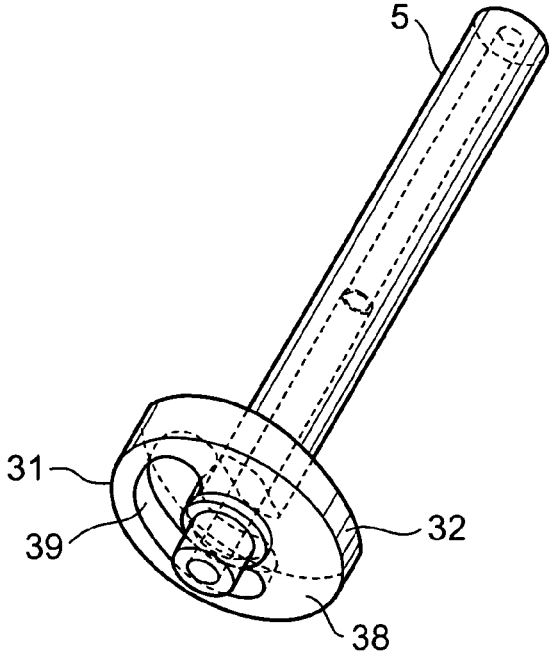
FIG. 24 is a perspective view of the rotary shaft which includes the compression member of the compressor of FIG. 14.

Next, referring to FIGS. 14 to 24, the compressor C of a second embodiment will be described. FIG. 14 is a vertical sectional side view of the compressor C of the second embodiment, FIG. 15 is another vertical sectional side view, FIGS. 16 to 18 are perspective views of a compression element 3 of the compressor C in this case, FIGS. 19, 20 are side views thereof, FIGS. 21 and 22 are side views of a rotary shaft 5 which includes a compression member 9, FIG. 23 is a bottom view, and FIG. 24 is a perspective view.

Throughout the drawings, portions denoted by reference numerals similar to those of FIGS. 1 to 13 exhibit identical or similar functions, and thus description thereof will be omitted. In this case, a recess 39 is formed from a bottom surface (other surface) 38 in a portion corresponding to a thick part 31 of the compression member 9. A depth of the recess 39 is formed along a slope of an upper surface 33, and a position corresponding to a top dead center 33A is recessed most deeply.

Because of thick and thin parts 31, 32 formed in the compression member 9, weight of the thick part 31 becomes larger than that of the thin part 32 in this state, causing weight eccentricity. However, by forming the recess 39 as in the case of the embodiment, it is possible to reduce the weight of the thick part 31 side. Thus, the weight of the compression member 9 is made uniform in a full periphery around the rotary shaft 5, and the occurrence of vibration by eccentricity can be suppressed without using any balance weights.

Third Embodiment

Figure 25:
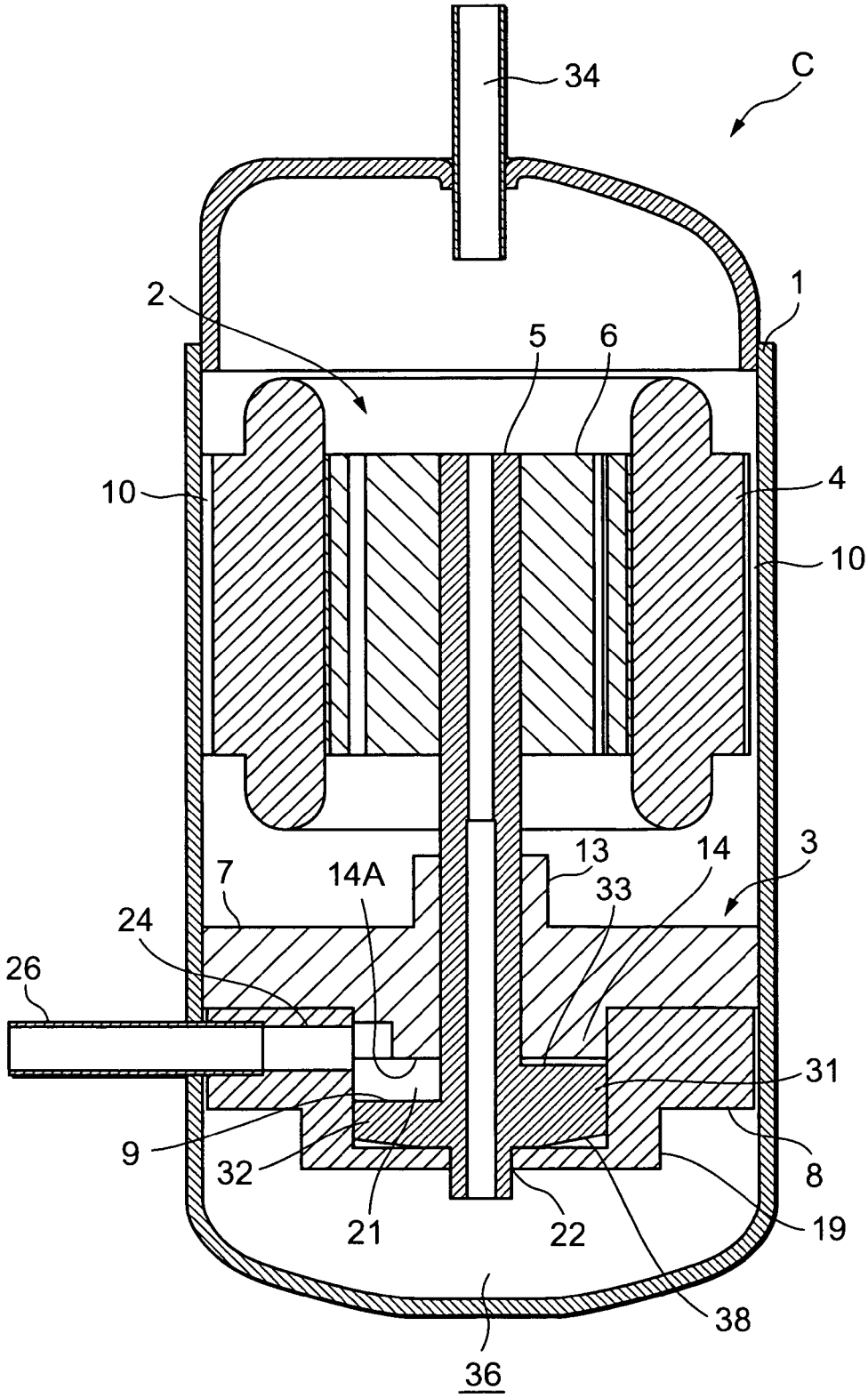
FIG. 25 is a vertical sectional side view showing a compressor according to a third embodiment of the present invention.
Figure 26:
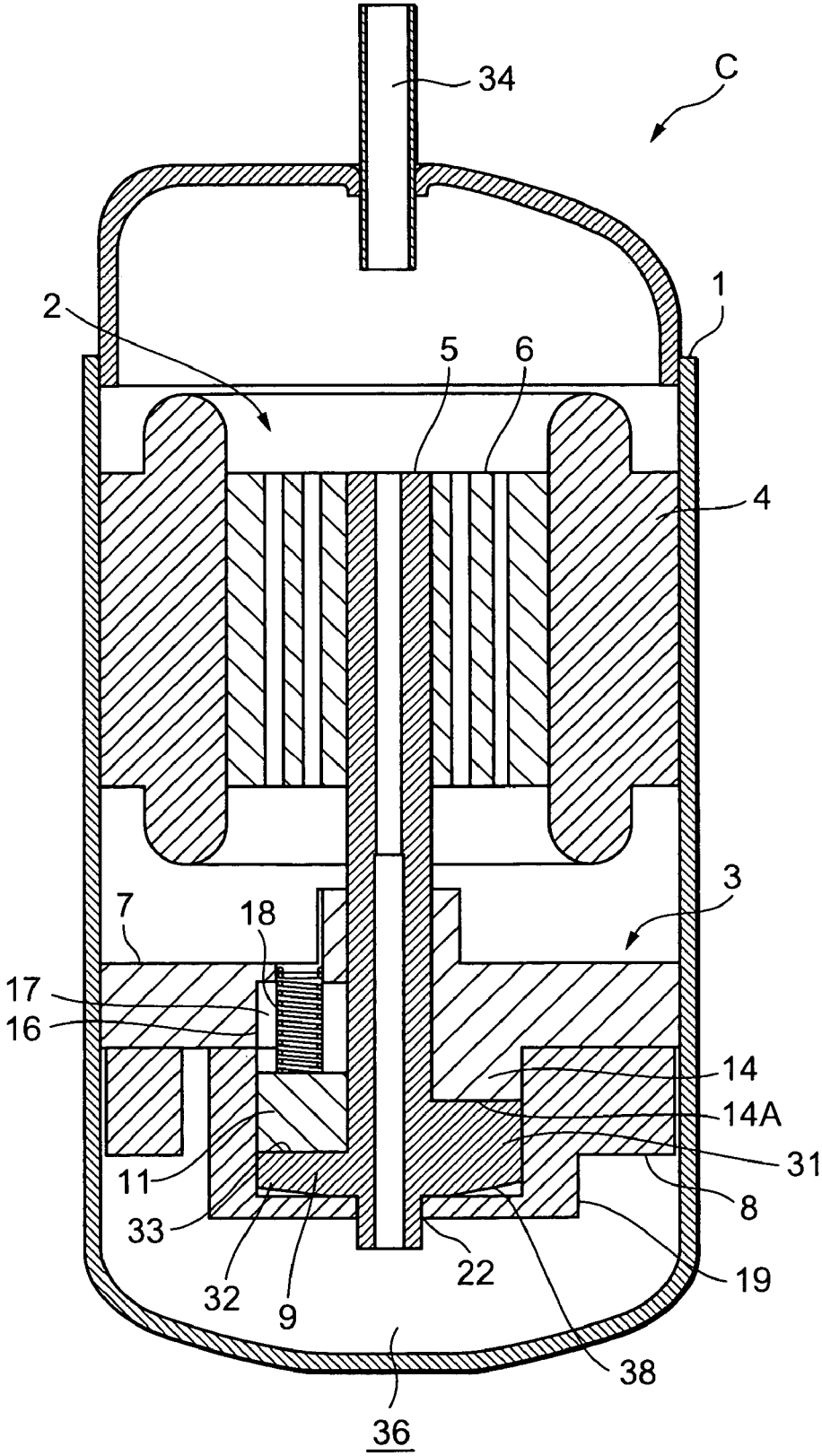
FIG. 26 is another vertical sectional side view of the compressor of FIG. 25.
Figure 32:
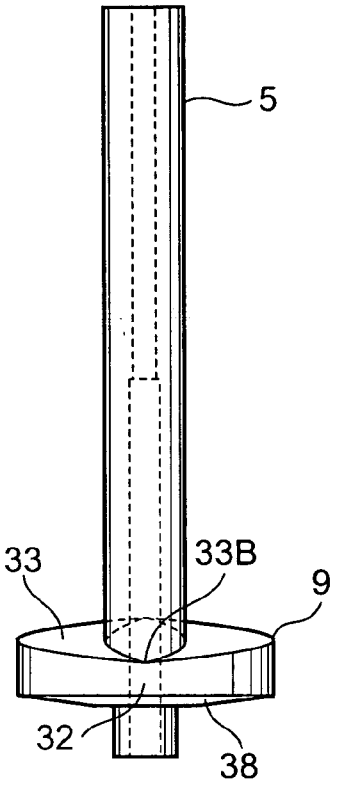
FIG. 32 is a side view of a rotary shaft which includes a compression member of the compressor of FIG. 25.
Figure 33:
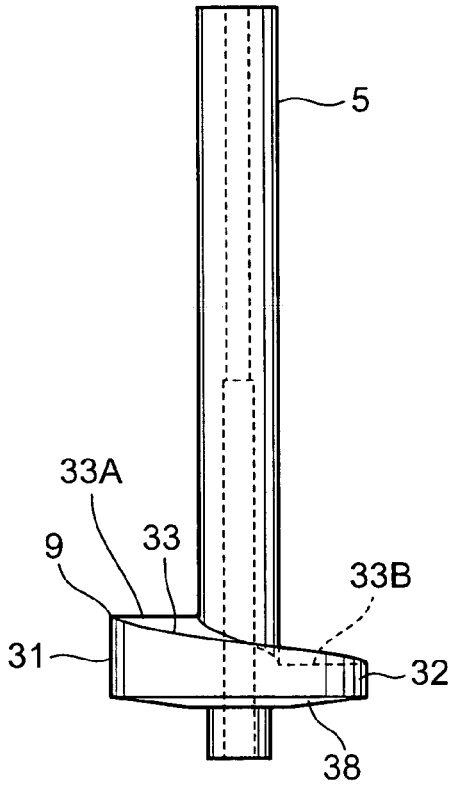
FIG. 33 is another side view of the rotary shaft which includes the compression member of the compressor of FIG. 25.
Figure 34:
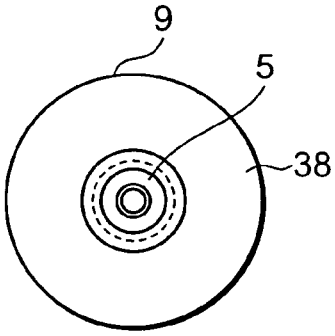
FIG. 34 is a bottom view of the rotary shaft which includes the compression member of the compressor of FIG. 25.
Figure 35:
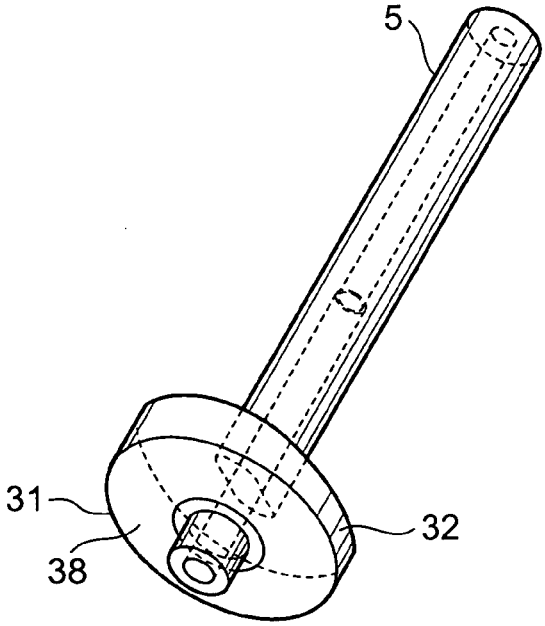
FIG. 35 is a perspective view of the rotary shaft which includes the compression member of the compressor of FIG. 25.

Next, referring to FIGS. 25 to 35, the compressor C of a third embodiment will be described. FIG. 25 is a vertical sectional side view of the compressor C of the second embodiment, FIG. 26 is another vertical sectional side view, FIGS. 27 to 29 are perspective views of a compression element 3 of the compressor C in this case, FIGS. 30, 31 are side views thereof, FIGS. 32 and 33 are side views of a rotary shaft 5 which includes a compression member 9 in this case, FIG. 34 is a bottom view, and FIG. 35 is a perspective view.

Throughout the drawings, portions denoted by reference numerals similar to those of FIGS. 1 to 24 exhibit identical or similar functions, and thus description thereof will be omitted. A bottom surface (other surface) 38 of the compression member 9 is formed to be a slope directed from the rotary shaft 5 side to a peripheral part in which the peripheral part side rises to approach an upper surface 33 side. Thus, because air resistance during rotation of the compression member 9 caused by rotation of the rotary shaft 5 is reduced, running efficiency can be improved more.

Fourth Embodiment

Figure 36:
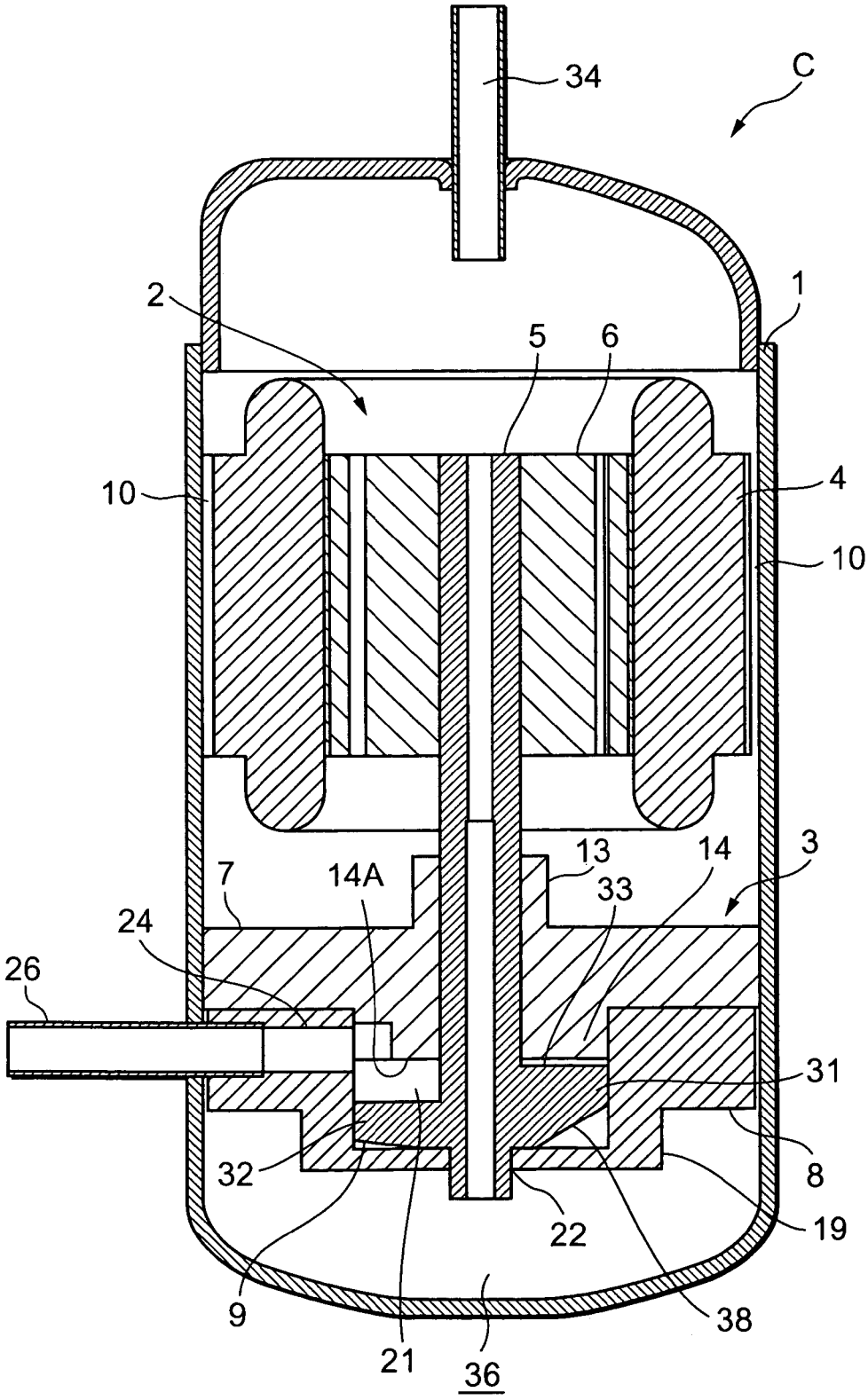
FIG. 36 is a vertical sectional side view showing a compressor according to a fourth embodiment of the present invention.
Figure 37:
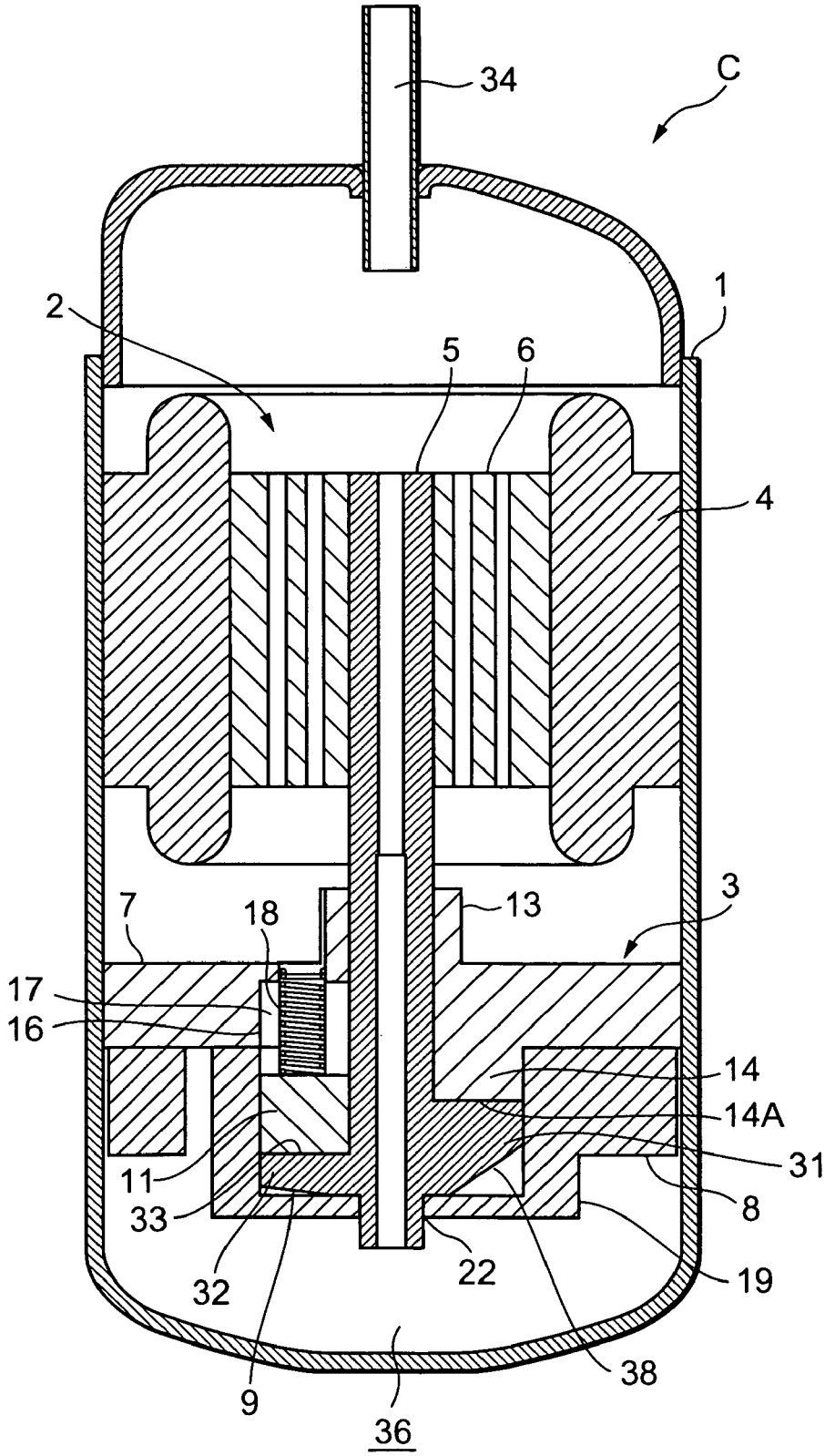
FIG. 37 is another vertical sectional side view of the compressor of FIG. 36.

Next, referring to FIGS. 36 to 42, the compressor C of a fourth embodiment will be described. FIG. 36 is a vertical sectional side view of the compressor C of the fourth embodiment, FIG. 37 is another vertical sectional side view, FIGS. 38 to 40 are perspective views of a compression element 3 of the compressor C in this case, and FIGS. 41, 42 are side views thereof.

Throughout the drawings, portions denoted by reference numerals similar to those of FIGS. 1 to 35 exhibit identical or similar functions, and thus description thereof will be omitted. In this case, as in the case of the third embodiment, a bottom surface (other surface) 38 of a compression member 9 is formed to be a slope as a whole directed from a rotary shaft 5 side to a peripheral part in which the peripheral part side rises to approach an upper surface 33 side. Additionally, in this case, the slope of the bottom surface 38 is formed to be steep in a thick part 31 side. Thus, air resistance during rotation of the compression member 9 caused by rotation of the rotary shaft 5 is reduced, and running efficiency is improved more. Weight of the compression member 9 is made uniform in a full periphery around the rotary shaft 5, and the occurrence of vibration by eccentricity can be suppressed without using any balance weights.

Fifth Embodiment

Figure 43:
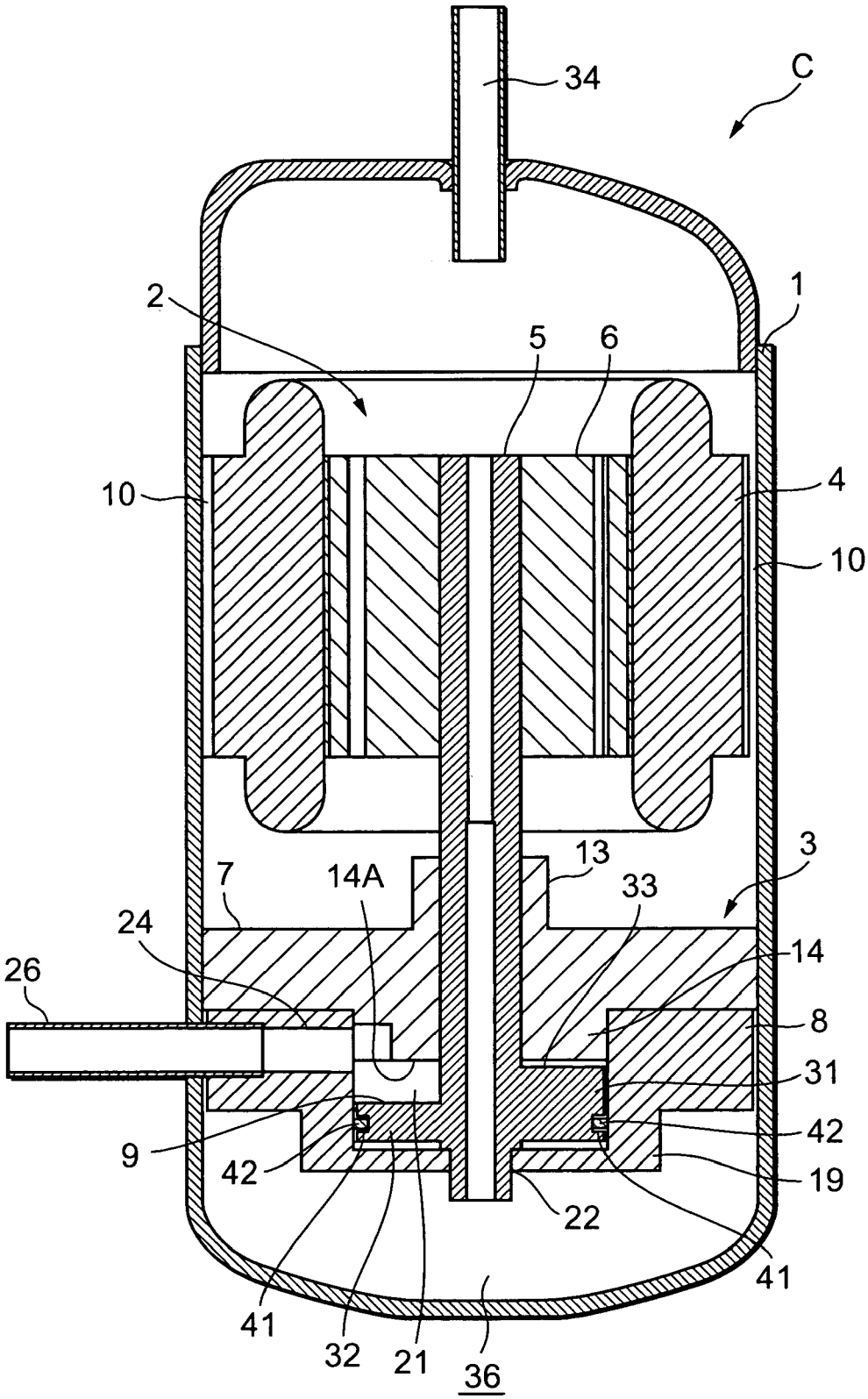
FIG. 43 is a vertical sectional side view showing a compressor according to a fifth embodiment of the present invention.
Figure 44:
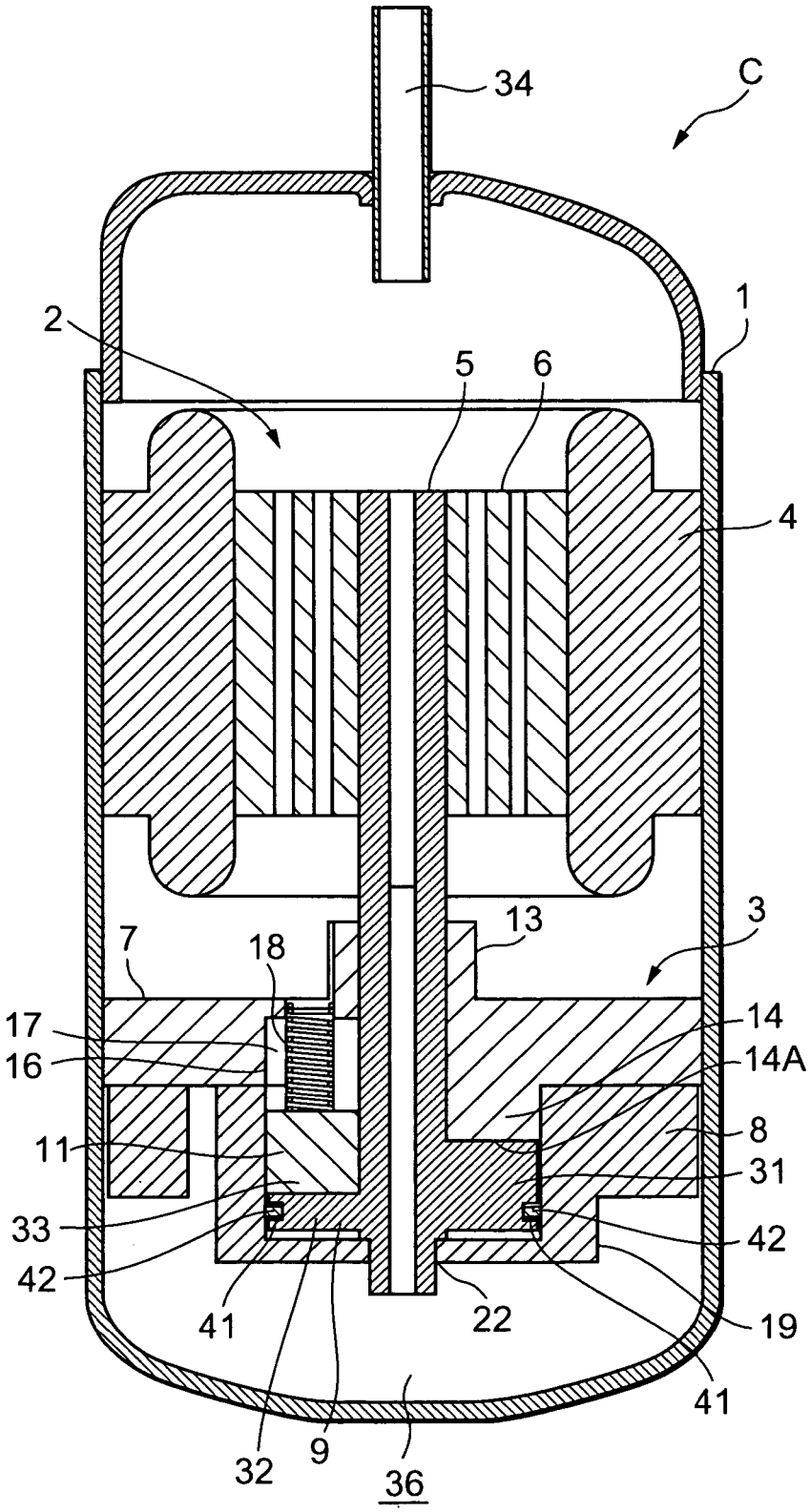
FIG. 44 is another vertical sectional side view of the compressor of FIG. 43.
Figure 50:
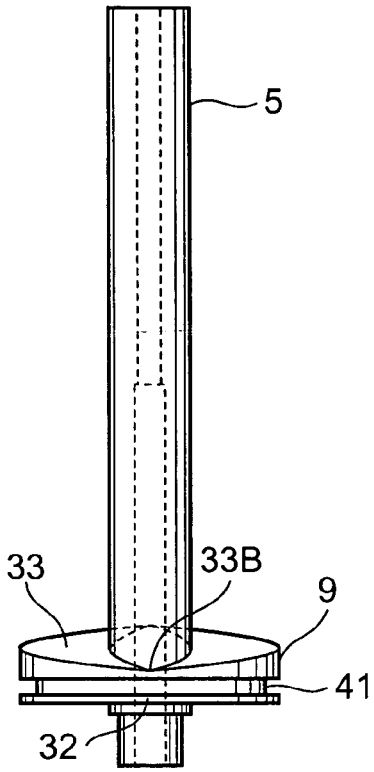
FIG. 50 is a side view of a rotary shaft which includes a compression member of the compressor of FIG. 43.
Figure 51:
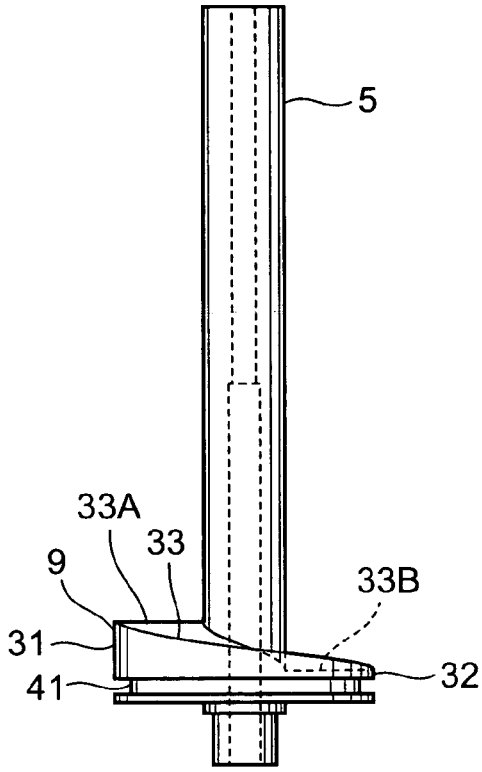
FIG. 51 is another side view of the rotary shaft which includes the compression member of the compressor of FIG. 43.
Figure 52:
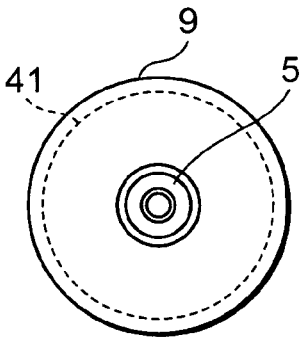
FIG. 52 is a bottom view of the rotary shaft which includes the compression member of the compressor of FIG. 43.
Figure 53:
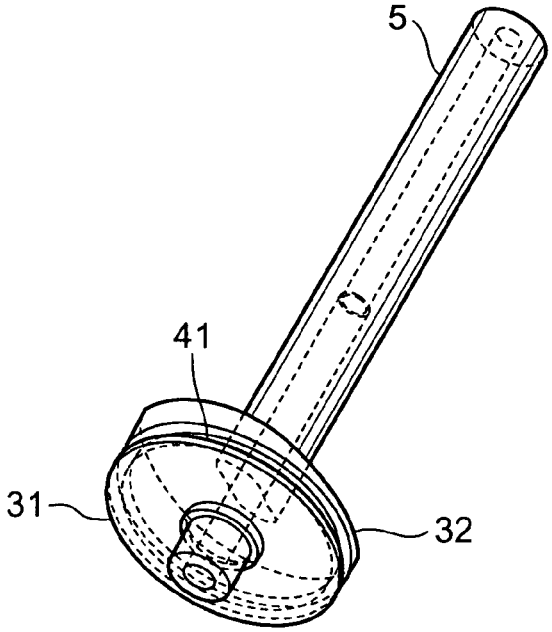
FIG. 53 is a perspective view of the rotary shaft which includes the compression member of the compressor of FIG. 43.
Figure 54:
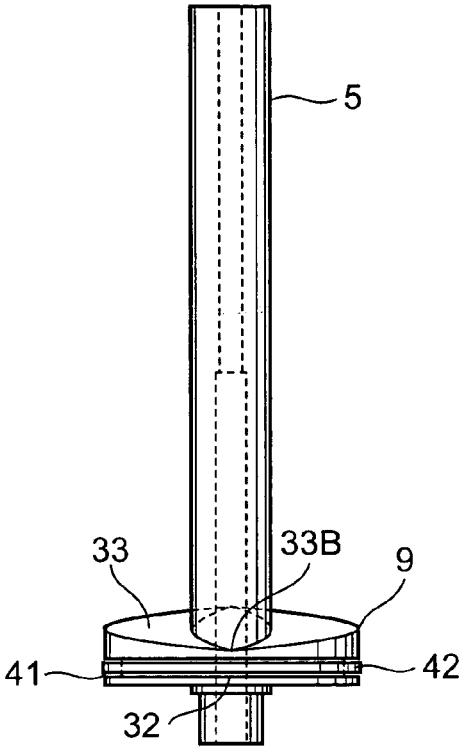
FIG. 54 is a side view of the rotary shaft which includes the compression member of the compressor of FIG. 43 in a piston ring mounted state.
Figure 55:
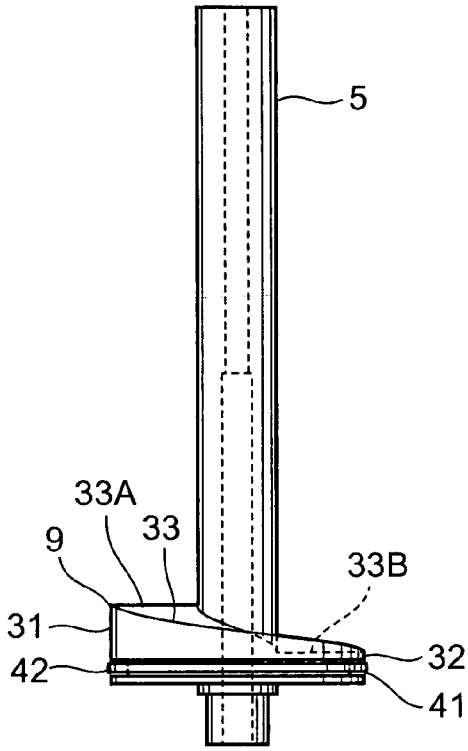
FIG. 55 is another side view of the rotary shaft which includes the compression member of the compressor of FIG. 43 in the piston ring mounted state.
Figure 56:
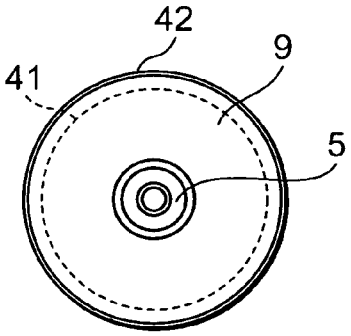
FIG. 56 is a bottom view of the rotary shaft which includes the compression member of the compressor of FIG. 43 in the piston ring mounted state.
Figure 57:
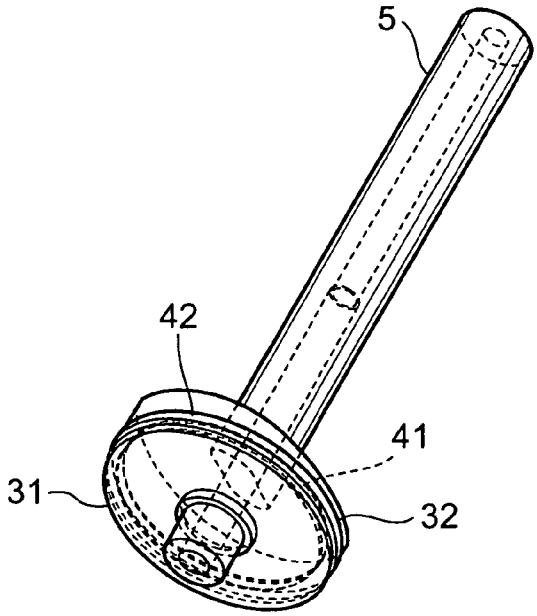
FIG. 57 is a perspective view of the rotary shaft which includes the compression member of the compressor of FIG. 43 in the piston ring mounted state.

Next, referring to FIGS. 43 to 57, the compressor C of a fifth embodiment will be described. FIG. 43 is a vertical sectional side view of the compressor C of the fifth embodiment, FIG. 44 is another vertical sectional side view, FIGS. 45 to 47 are perspective views of a compression element 3 of the compressor C in this case, FIGS. 48, 49 are side views thereof, FIGS. 50 and 51 are side views of a rotary shaft 5 which includes a compression member 9 in this case, FIG. 52 is a bottom view, and FIG. 53 is a perspective view.

Throughout the drawings, portions denoted by reference numerals similar to those of FIGS. 1 to 42 exhibit identical or similar functions, and thus description thereof will be omitted. In this case, a groove 41 is formed in a full periphery around a side face of the compression member 9, and a piston ring 42 is mounted in the groove 41 as shown in FIGS. 54 to 57. This piston ring 42 is made of PEEK or a fluororesin, and seals a clearance between a peripheral side face of the compression member 9 and an inner wall of a recess 19 of a cylinder 8. Thus, by disposing the piston ring 42, sealing is surely carried out between the compression member 9 and the cylinder 8 to enable surer prevention of efficiency deterioration caused by refrigerant leakage.

The embodiments have been described by taking the example of the compressor used for the refrigerant circuit of the refrigerator to compress the refrigerant. However, the embodiments are in no way limitative of the invention, and the invention can be applied to a so-called air compressor which sucks, compresses and discharges air.

What is claimed is:

1. A compressor comprising:

a compression element including a cylinder having a compression space formed therein;

a suction port and a discharge port which communicate with the compression space in the cylinder;

a compression member having continuous thick and thin parts, one surface of the compression member being inclined, the compression member being arranged in the cylinder to rotate, the compression member compressing fluids sucked through the suction port and discharging the compressed fluids through the discharge port;

a substantially rectangular vane which is arranged between the suction port and the discharge port to abut on one surface of the compression member and which partitions the compression space of the cylinder into a low pressure chamber and a high pressure chamber, wherein a recess is formed on another surface of the compression member to be positioned in the thick part.

2. A compressor comprising:

a compression element including a cylinder having a compression space formed therein;

a suction port and a discharge port which communicate with the compression space in the cylinder;

a compression member having continuous thick and thin parts, one surface of the compression member being inclined, the compression member being arranged in the cylinder to rotate, the compression member compressing fluids sucked through the suction port and discharging the compressed fluids through the discharge port;

a substantially rectangular vane which is arranged between the suction port and the discharge port to abut on one surface of the compression member and which partitions the compression space of the cylinder into a low pressure chamber and a high pressure chamber, wherein another surface of the compression member is inclined to approach a peripheral part thereof to one surface side.

3. The compressor according to claim 2, wherein the inclination of the another surface of the compression member is steeper in the thick part than in other parts of the another surface.

4. A compressor comprising:

a compression element including a cylinder having a compression space formed therein;

a suction port and a discharge port which communicate with the compression space in the cylinder;

a compression member having continuous thick and thin parts, one surface of the compression member being inclined, the compression member being arranged in the cylinder to rotate, the compression member compressing fluids sucked through the suction port and discharging the compressed fluids through the discharge port;

a substantially rectangular vane which is arranged between the suction port and the discharge port to abut on one surface of the compression member and which partitions the compression space of the cylinder into a low pressure chamber and a high pressure chamber; and a drive element and a rotary shaft which transmits a rotational force of the driving element to the compression member, wherein the compression element and the driving element are arranged in a sealed container, the suction port is connected to a suction pipe mounted to the sealed container, the discharge port communicates with the inside of the sealed container, and a discharge pipe is connected to the sealed container, and wherein a recess is formed on another surface of the compression member to be positioned in the thick part.

5. A compressor comprising:

a compression element including a cylinder having a compression space formed therein;

a suction port and a discharge port which communicate with the compression space in the cylinder;

a compression member having continuous thick and thin parts, one surface of the compression member being inclined, the compression member being arranged in the cylinder to rotate, the compression member compressing fluids sucked through the suction port and discharging the compressed fluids through the discharge port;

a substantially rectangular vane which is arranged between the suction port and the discharge port to abut on one surface of the compression member and which partitions the compression space of the cylinder into a low pressure chamber and a high pressure chamber; and a drive element and a rotary shaft which transmits a rotational force of the driving element to the compression member, wherein the compression element and the driving element are arranged in a sealed container, the suction port is connected to a suction pipe mounted to the sealed container, the discharge port communicates with the inside of the sealed container, and a discharge pipe is connected to the sealed container, wherein the compression element comprises a support member which has a main bearing of the rotary shaft to close an opening of the cylinder, and the cylinder comprises a sub-bearing of the rotary shaft positioned on a side opposite to the support member, and wherein a recess is formed on another surface of the compression member to be positioned in the thick part.

6. A compressor comprising:

a compression element including a cylinder having a compression space formed therein;

a suction port and a discharge port which communicate with the compression space in the cylinder;

a compression member having continuous thick and thin parts, one surface of the compression member being inclined, the compression member being arranged in the cylinder to rotate, the compression member compressing fluids sucked through the suction port and discharging the compressed fluids through the discharge port;

a substantially rectangular vane which is arranged between the suction port and the discharge port to abut on one surface of the compression member and which partitions the compression space of the cylinder into a low pressure chamber and a high pressure chamber; and a drive element and a rotary shaft which transmits a rotational force of the driving element to the compression member, wherein the compression element and the driving element are arranged in a sealed container, the suction port is connected to a suction pipe mounted to the sealed container, the discharge port communicates with the inside of the sealed container, and a discharge pipe is connected to the sealed container, wherein the compression element comprises a support member which has a main bearing of the rotary shaft to close an opening of the cylinder, and the cylinder comprises a sub-bearing of the rotary shaft positioned on a side opposite to the support member, wherein the vane is arranged in a slot formed in the support member to reciprocate, and urging means is disposed in the support member to always urge the vane to one surface side of the compression member, and wherein a recess is formed on another surface of the compression member to be positioned in the thick part.

7. A compressor comprising:

a compression element including a cylinder having a compression space formed therein;

a suction port and a discharge port which communicate with the compression space in the cylinder;

a compression member having continuous thick and thin parts, one surface of the compression member being inclined, the compression member being arranged in the cylinder to rotate, the compression member compressing fluids sucked through the suction port and discharging the compressed fluids through the discharge port;

a substantially rectangular vane which is arranged between the suction port and the discharge port to abut on one surface of the compression member and which partitions the compression space of the cylinder into a low pressure chamber and a high pressure chamber; and a drive element and a rotary shaft which transmits a rotational force of the driving element to the compression member, wherein the compression element and the driving element are arranged in a sealed container, the suction port is connected to a suction pipe mounted to the sealed container, the discharge port communicates with the inside of the sealed container, and a discharge pipe is connected to the sealed container, and wherein another surface of the compression member is inclined to approach a peripheral part thereof to one surface side.

8. The compressor according to claim 7, wherein the inclination of the another surface of the compression member is steeper in the thick part than in other parts of the another surface.

9. A compressor comprising:

a compression element including a cylinder having a compression space formed therein;

a suction port and a discharge port which communicate with the compression space in the cylinder;

a compression member having continuous thick and thin parts, one surface of the compression member being inclined, the compression member being arranged in the cylinder to rotate, the compression member compressing fluids sucked through the suction port and discharging the compressed fluids through the discharge port;

a substantially rectangular vane which is arranged between the suction port and the discharge port to abut on one surface of the compression member and which partitions the compression space of the cylinder into a low pressure chamber and a high pressure chamber; and a drive element and a rotary shaft which transmits a rotational force of the driving element to the compression member, wherein the compression element and the driving element are arranged in a sealed container, the suction port is connected to a suction pipe mounted to the sealed container, the discharge port communicates with the inside of the sealed container, and a discharge pipe is connected to the sealed container, wherein the compression element comprises a support member which has a main bearing of the rotary shaft to close an opening of the cylinder, and the cylinder comprises a sub-bearing of the rotary shaft positioned on a side opposite to the support member, and wherein another surface of the compression member is inclined to approach a peripheral part thereof to one surface side.

10. The compressor according to claim 9, wherein the inclination of the another surface of the compression member is steeper in the thick part than in other parts of the another surface.

11. A compressor comprising:

a compression element including a cylinder having a compression space formed therein;

a suction port and a discharge port which communicate with the compression space in the cylinder;

a compression member having continuous thick and thin parts, one surface of the compression member being inclined, the compression member being arranged in the cylinder to rotate, the compression member compressing fluids sucked through the suction port and discharging the compressed fluids through the discharge port;

a substantially rectangular vane which is arranged between the suction port and the discharge port to abut on one surface of the compression member and which partitions the compression space of the cylinder into a low pressure chamber and a high pressure chamber; and a drive element and a rotary shaft which transmits a rotational force of the driving element to the compression member, wherein the compression element and the driving element are arranged in a sealed container, the suction port is connected to a suction pipe mounted to the sealed container, the discharge port communicates with the inside of the sealed container, and a discharge pipe is connected to the sealed container, wherein the compression element comprises a support member which has a main bearing of the rotary shaft to close an opening of the cylinder, and the cylinder comprises a sub-bearing of the rotary shaft positioned on a side opposite to the support member, wherein the vane is arranged in a slot formed in the support member to reciprocate, and urging means is disposed in the support member to always urge the vane to one surface side of the compression member, and wherein another surface of the compression member is inclined to approach a peripheral part thereof to one surface side.

12. The compressor according to claim 11, wherein the inclination of the another surface of the compression member is steeper in the thick part than in other parts of the another surface.

* * * * *